US011692332B2

(12) United States Patent
Nakajima et al.

(10) Patent No.: US 11,692,332 B2
(45) Date of Patent: Jul. 4, 2023

(54) HYDRAULIC CONTROL SYSTEM

(71) Applicant: Caterpillar SARL, Geneva (CH)

(72) Inventors: Hideki Nakajima, Akashi (JP); Koichi Kiyasu, Akashi (JP)

(73) Assignee: Caterpillar SARL, Geneva (CH)

( * ) Notice: Subject to any disclaimer, the term of this patent is extended or adjusted under 35 U.S.C. 154(b) by 0 days.

(21) Appl. No.: 17/632,075

(22) PCT Filed: Aug. 5, 2020

(86) PCT No.: PCT/EP2020/025360
§ 371 (c)(1),
(2) Date: Feb. 1, 2022

(87) PCT Pub. No.: WO2021/028073
PCT Pub. Date: Feb. 18, 2021

(65) Prior Publication Data

US 2022/0275605 A1 Sep. 1, 2022

(30) Foreign Application Priority Data

Aug. 9, 2019 (JP) ..... 2019-147364

(51) Int. Cl.
*E02F 9/22* (2006.01)
*F15B 11/16* (2006.01)
*F15B 11/17* (2006.01)

(52) U.S. Cl.
CPC ..... *E02F 9/2242* (2013.01); *E02F 9/2285* (2013.01); *E02F 9/2292* (2013.01); (Continued)

(58) Field of Classification Search
CPC ..... E02F 9/2239; E02F 9/2242; F15B 11/165; F15B 11/17
See application file for complete search history.

(56) References Cited

U.S. PATENT DOCUMENTS 5,048,293 A * 9/1991 Aoyagi ..... E02F 9/2235 60/420
5,148,676 A 9/1992 Moriya et al.
(Continued)

FOREIGN PATENT DOCUMENTS

JP H0979212 A 3/1997
JP 2010-236607 A 10/2010
(Continued)

OTHER PUBLICATIONS

International Search Report related to Application No. PCT/EP2020/025360; reported dated Dec. 4, 2020.

*Primary Examiner* — Michael Leslie

(57) ABSTRACT

To improve operability and work efficiency while achieving reduction of the number of parts and simplification of circuit structure, in a hydraulic control system equipped with hydraulic actuators whose hydraulic power sources are both the first, second hydraulic pumps. The hydraulic control system is provided with the stick directional switching valve; the main-side, sub-side supply oil passages connecting the hydraulic pumps to the stick directional switching valve; and the stick flow rate control valve which is placed in the sub-side supply oil passage, and controls the supply flow rate from the hydraulic pump when the supply flow rate to the stick cylinder requires the supply flow rates from both the hydraulic pumps, wherein the stick directional switching valve is configured such that the discharge flow rate control is performed in the entire area of the spool stroke, and the supply flow rate control is performed at the first region of the former half of the spool stroke, but not performed at the second region of the latter half of the spool stroke.

5 Claims, 9 Drawing Sheets

(52) U.S. Cl.
CPC ..... *E02F 9/2296* (2013.01); *F15B 11/165* (2013.01); *F15B 11/17* (2013.01); *E02F 9/2235* (2013.01); *E02F 9/2267* (2013.01); *F15B 2211/3144* (2013.01); *F15B 2211/351* (2013.01); *F15B 2211/455* (2013.01)

(56) References Cited

U.S. PATENT DOCUMENTS

| | | | | |
|---|---|---|---|---|
| 5,829,252 | A * | 11/1998 | Hirata | E02F 9/2242 60/429 |
| 10,309,079 | B2 * | 6/2019 | Moriki | E02F 9/2282 |
| 2003/0172650 | A1 | 9/2003 | Konishi et al. | |

FOREIGN PATENT DOCUMENTS

| | | | |
|---|---|---|---|
| JP | 2015-081458 | A | 4/2015 |
| JP | 2017-020604 | A | 1/2017 |

* cited by examiner

HYDRAULIC CONTROL SYSTEM

CROSS-REFERENCE TO RELATED APPLICATION

This Application is a 35 USC § 371 US National Stage filing of International Application No. PCT/EP2020/025360 filed on Aug. 5, 2020 which claims priority under the Paris Convention to Japanese Patent Application No. 2019-147364 filed on Aug. 9, 2019.

TECHNICAL FIELD

The present invention relates to a technical field of a hydraulic control system in a working machine such as a hydraulic shovel.

BACKGROUND ART

Generally, among hydraulic control systems utilized in work machines such as hydraulic shovels for example, some are conventionally well-known, which are configured to include a first, a second hydraulic pumps; a hydraulic actuator supplied with pressurized oil from both the first, second hydraulic pumps, a hydraulic actuator supplied with pressurized oil from either one of the first, second hydraulic pumps, as well as configured such that, two directional switching valves: a first directional switching valve that controls a supply flow rate from the first hydraulic pump and a second directional switching valve that controls a supply flow rate from the second hydraulic pump are further provided, to a large flow rate hydraulic actuator supplied with pressurized oil from the both hydraulic pumps, and a total flow rate from these two directional switching valves is supplied to the hydraulic actuator (for example, refer to Patent Literature 1). However, in such hydraulic control systems, the hydraulic actuator supplied with pressurized oil from both the hydraulic pumps requires two directional switching valves: the first directional switching valve and the second directional switching valve, and further requires additional actuators for switching between these two directional switching valves respectively, resulting in the increase of the number of parts and the complication of circuit structure. In addition, such hydraulic control systems are configured so as to perform a bleed flow rate control by using a center bypass line passing through each directional switching valve positioned at a neutral position, as well as a priority circuit called a tandem circuit is provided by using the center bypass line, in order to ensure operability at the time of a combined operation for operating simultaneously a plurality of hydraulic actuators, but the center bypass line is a line used for the bleed flow rate control as described above, and therefore the degree of freedom of design as the priority circuit become low.

On the other hand, there is known a technique in which, in a hydraulic control system that includes a first, a second hydraulic pumps; a first, a second hydraulic actuators supplied with pressurized oil from both the first, second pumps; a first directional switching valve that controls a supply flow rate to the first hydraulic actuator; and a second directional switching valve that controls a supply flow rate to the second hydraulic actuator, there are provided first, second feeder lines for connecting the first, second hydraulic pumps to pump ports of the first directional switching valve respectively, and third, fourth feeder lines for connecting the first, second hydraulic pumps to pump ports of the second directional switching valve, as well as further first through fourth auxiliary valves each having a variable resistance function are arranged in these first to fourth feeder lines respectively (for example, refer to Patent Literature 2). In this hydraulic control system, even a large flow rate hydraulic actuator supplied with pressurized oil from both the first, second hydraulic pumps requires only one directional switching valve, which enables achieving the simplification of circuit structure, as well as the priority of the supply flow rates from the first, second hydraulic pumps to the first, second hydraulic actuators can be adjusted, by reducing or shutting off the variable resistance function of the first, second auxiliary valves depending on an operation amount of the second directional switching valve, and by reducing or shutting off the variable resistance function of the third and fourth auxiliary valves depending on an operation amount of the first directional switching valve.

Then, a directional switching valve like the one as disclosed in the Patent Literatures 1, 2 is composed of a spool valve for switching between supply and discharge directions of oil to and from a hydraulic actuator as well as performing a supply flow rate control and a discharge flow rate control. Control of supply flow rate and the discharge flow rate will be performed in accordance with an increase or decrease in opening areas of supply valve passage, discharge valve passages provided in the spool valve. In this case, however, the relationship between the opening areas of the supply valve passage and the discharge valve passage with respect to movement positions of the spool is uniquely determined, and therefore, for example, a single operation for driving singly one hydraulic actuator, a combined operation for driving simultaneously a plurality of hydraulic actuators cannot be performed, or the supply flow rate and the discharge flow rate cannot be individually controlled depending on workloads or other factors. However, as disclosed in the Patent Literature 2, in case where only one directional switching valve is provided for a large flow rate hydraulic actuator supplied with pressurized oil from both the first, second hydraulic pumps, if the supply flow rate and discharge flow rate cannot be controlled individually depending on workloads or other factors, then there is a risk that operability may be deteriorated and work efficiency may be lowered especially in a flow rate range that requires a large flow rate. Thus, in hydraulic control systems equipped with first, second hydraulic pumps, and a hydraulic actuator supplied with pressurized oil from both the first, second hydraulic pumps, there are some that are configured such that a first flow rate control valve of electronic control type for controlling the supply flow rate from the first hydraulic pump, and a second flow rate control valve of electronic control type for controlling the supply flow rate from the second hydraulic pumps are provided, when controlling the supply flow rate to the hydraulic actuator, and a total flow rate from these first, second flow rate control valves is supplied to the hydraulic actuator via the directional switching valve of which supply valve passage to the hydraulic actuator is formed (for example, Patent Literature 3). In such hydraulic control systems, similarly to the Patent Literature 2, even a large flow rate hydraulic actuator supplied with the pressurized oil from both the first, second hydraulic pumps requires only one direction switching valve, resulting in achieving the simplification of circuit structure, as well as enabling to separately control the supply flow rate from the first hydraulic pump and the supply flow rate from the second hydraulic pump, and thus enabling to perform control of a pump flow rate distribution at the time of combined operation with other hydraulic actuators with a high precision. In addition, in such hydraulic control systems, because the configuration is such that the supply flow rate control to the hydraulic actuators is performed by the first, second flow rate control valves, and the directional switching valve performs control of the supply and discharge directions of oil and the discharge flow rate to and from the hydraulic actuators, it becomes possible to perform the supply flow rate control and the discharge flow rate control to and from the hydraulic actuators by separate valves, and it becomes possible to change the relationship between the supply flow rate and the discharge flow rate depending on independent operation or combined operation, or various work contents such as workloads, thereby enabling contribution to the improvement of work efficiency and operability.

PRIOR ART LITERATURES

Patent Literatures

[Patent Literature 1] Japanese Patent Application Laid-Open No. 2010-236607

[Patent Literature 2] Japanese Patent Application Laid-Open No. 9-79212

[Patent Literature 3] Japanese Patent Application Laid-Open No. 2017-20604

SUMMARY OF THE INVENTION

Problems to be Solved by the Invention

However, the hydraulic control system disclosed in the Patent Literature 3 requires only one directional switching valve, with respect to the hydraulic actuators supplied with oil from both the first, second hydraulic pumps, but requires two flow rate control valves: a first flow rate control valve for controlling the supply flow rate from the first hydraulic pump and a second flow rate control valve for controlling the supply flow rate from the second hydraulic pump, besides two solenoid proportional valves for activating these first, second flow rate control valves respectively, which increases the cost, and therefore additional reduction of the number of parts and the simplification of the circuit structure are desired, and here there are problems to be solved by the present invention.

Means for Solving the Problems

The present invention has been created with an object of solving these problems in view of the above circumstances, and a first aspect of the present invention provides a hydraulic control system equipped with first, second hydraulic pumps; a first hydraulic actuator whose hydraulic supply source is both the first, second hydraulic pumps; and other hydraulic actuators whose hydraulic supply sources are at least one of the first, second hydraulic pumps, the hydraulic control system further comprising: a first hydraulic actuator directional switching valve that has a supply valve passage and a discharge valve passage to and from the first hydraulic actuator and switches between supply and discharge directions; a main-side supply oil passage, a sub-side supply oil passage that connects the first, second hydraulic pumps to pump ports of the first hydraulic actuator directional switching valve, respectively; a first hydraulic actuator flow rate control valve that is placed at the sub-side supply oil passage, and controls a supply flow rate from the second hydraulic pump to the first hydraulic actuator directional switching valve; and a control means for electronically controlling the first hydraulic actuator directional switching valve and the first hydraulic actuator flow rate control valve, wherein the first hydraulic actuator flow rate control valve is configured such that in a state where the first hydraulic actuator flow rate control valve is closing the sub-side supply oil passage, only a supply flow rate from the first hydraulic pump via the main-side supply oil passage is supplied to the first hydraulic actuator directional switching valve, and in a state where the first hydraulic actuator flow rate control valve is opening the sub-side supply oil passage, a control flow rate from the second hydraulic pump whose flow rate has been controlled by the first hydraulic actuator flow control valve and the supply flow rate from the first hydraulic pump are supplied to the first hydraulic actuator directional switching valve; and on the other hand, wherein the first hydraulic actuator directional switching valve is a spool valve having a spool that is moved in proportion to an operation amount of a first hydraulic actuator operation lever, and is configured, in a first region of the former half of the spool stroke, to perform a supply flow rate control in accordance with an opening area of the supply valve passage that is increased or decreased depending on a spool stroke amount, and at a second region of the latter half of the spool stroke, to supply the flow rate input to a pump port to the first hydraulic actuator as it is without performing the supply flow rate control, since the opening area of the supply valve passage is set wider than when the supply flow rate control is performed; on the other hand, to perform a discharge flow rate control in accordance with an opening area of the discharge valve passage that is increased or decreased depending on the spool stroke amount in both the first and second regions; as well as, wherein the control means is configured, in case where only the supply flow rate from the first hydraulic pump is sufficient for the supply flow rate to the first hydraulic actuator, to cause the sub-side supply oil passage to be closed by the first hydraulic actuator flow rate control valve, as well as to cause the spool of the first hydraulic actuator directional switching valve to be positioned at the first region, to perform the supply flow rate control from the first hydraulic pump to the first hydraulic actuator in accordance with an opening area of the supply valve passage of the first hydraulic actuator directional switching valve; on the other hand, in case where the supply flow rate to the first hydraulic actuator requires the flow rates from both the first and second hydraulic pumps, then to control the first hydraulic actuator flow rate control valve so that the supply flow rate from the second hydraulic pump to the first hydraulic actuator directional switching valve is increased in response to an operation amount of the first hydraulic actuator operation lever, and to cause the spool of the first hydraulic actuator directional switching valve to be positioned at the second region, to allow a total flow rate of the control flow rate from the second hydraulic pump controlled by the first hydraulic actuator flow rate control valve and the supply flow rate from the first hydraulic pump to be supplied to the first hydraulic actuator via the supply valve passage of the first hydraulic actuator directional switching valve.

A second exemplary aspect of the present invention provides the hydraulic control system according the first aspect, wherein a pump control means for controlling a discharge flow rate of the first, second hydraulic pumps in accordance with an amount of a hydraulic actuator operation lever is provided, as well as the pump control means, in case where only the first hydraulic actuator operation lever is operated without other hydraulic actuators operation levers being operated, increases the discharge flow rate of the first hydraulic pump in proportion to an operation amount of the operation lever, when an operation amount of the first hydraulic actuator operation lever is less than a set value; on the other hand, further increases the discharge flow rate of the first hydraulic pump in proportion to the operation amount of the operation lever, when the discharge flow rate of the second hydraulic pump is maintained at a minimum flow rate, and the operation amount of the first hydraulic actuator operation lever is greater than or equal to a set value; on the other hand, increases the discharge flow rate of the second hydraulic pump in proportion to the operation amount of the operation lever.

A third exemplary aspect of the present invention provides the hydraulic control system according to the first or second aspect, further comprising bleed lines extending from the first, second hydraulic pumps to an oil tank respectively, and bleed valves that are electronically controlled by the control means, and control flow rates of the bleed lines respectively, wherein the control means performs a bleed flow rate control corresponding to each hydraulic actuator, in accordance with an operation amount of each hydraulic actuator operation lever.

A fourth exemplary aspect of the present invention provides the hydraulic control system according to the third aspect, wherein other hydraulic actuators include a second hydraulic actuator whose hydraulic supply source is only the first hydraulic pump, wherein the hydraulic control system further comprises: a second hydraulic actuator directional switching valve that is electronically controlled by the control means, and performs a supply flow rate control with respect to the second hydraulic actuator in accordance with an operation of a second hydraulic actuator operation lever, as well as switches between the supply and discharge directions of oil; a second hydraulic actuator supply oil passage that is provided in parallel with a first hydraulic actuator main-side supply oil passage and connects the first hydraulic pump to a pump port of the second hydraulic actuator directional switching valve; a bypass inlet oil passage that is branched and formed from the second hydraulic actuator supply oil passage and connects the first hydraulic pump to a bypass inlet port formed on the second hydraulic actuator directional switching valve; and a bypass outlet oil passage extending from a bypass outlet port formed on the second hydraulic actuator directional switching valve to a pump port of the first hydraulic actuator directional switching valve; as well as, wherein the second hydraulic actuator directional switching valve has a bypass valve passage extending from the bypass inlet port to the bypass outlet port, an opening area of the bypass valve passage is set so as to reach a maximum when the second hydraulic actuator operation lever is not operated, to decrease with increasing operation amount of the operation lever, and to close the valve passage when the operation amount of the operation lever is maximum; on the other hand, a throttle valve for throttling the supply flow rate from the first hydraulic pump to the first hydraulic actuator directional switching valve is provided, in the first hydraulic actuator main-side supply oil passage.

A fifth exemplary aspect of the present invention provides the hydraulic control system according to the fourth aspect, which is a hydraulic control system for a hydraulic shovel comprising a plurality of hydraulic actuators including a stick cylinder, a swing motor, wherein the first hydraulic actuator serves as the stick cylinder, and the second hydraulic actuator serves as the swing motor.

Advantageous Effects of the Invention

According to the first aspect of the present invention, a supply flow rate control and a discharge flow rate control can be separately performed in a large flow rate range requiring the supply flow rates from both the hydraulic pumps, while reducing the number of parts and simplifying the circuit structure, thereby enabling improvement of operability and work efficiency.

According to the second aspect of the present invention, discharge flow rates of the first, second hydraulic pumps can be supplied to a first hydraulic actuator directional switching valve and a first hydraulic actuator flow rate control valve without excess or deficiency.

According to the third aspect of the present invention, a bleed flow rate control can be performed separately from the supply flow rate control, the discharge flow rate control.

According to the fourth aspect of the present invention, a bypass valve passage formed in a second hydraulic actuator directional switching valve for prioritizing the second hydraulic actuator can be dedicated to exclusive use for a priority control, thereby enabling to increase the degree of freedom in design, and to perform the priority control with a high accuracy.

According to the fifth aspect of the present invention, in a hydraulic shovel, a swing priority control can be performed with a high accuracy in case where a stick cylinder and a swing motor are simultaneously operated.

DETAIL DESCRIPTION OF EMBODIMENTS

Hereinafter, embodiments of the present invention will be discussed with reference to the drawings.

Figure 1:
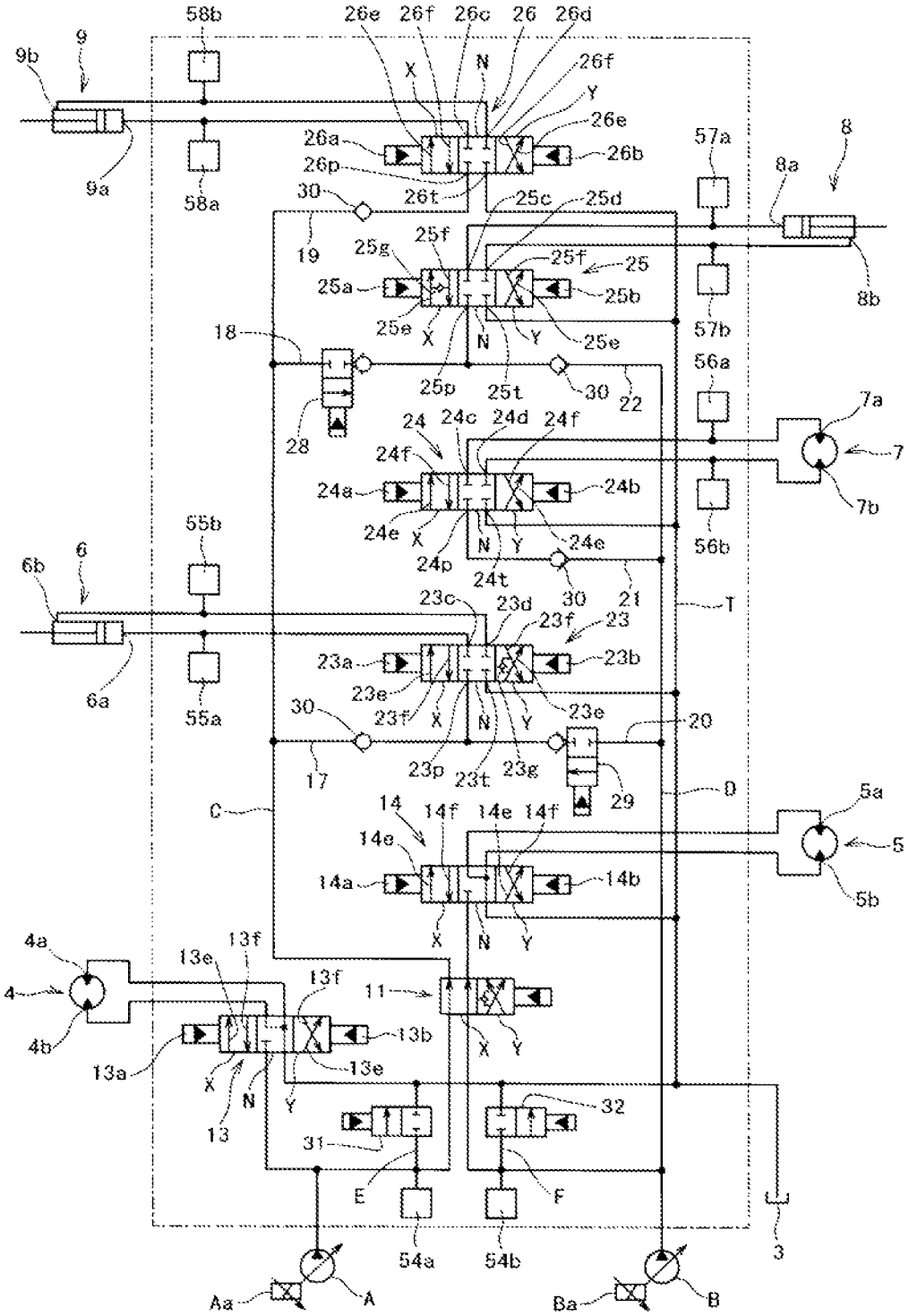
FIG. 1 is a hydraulic circuit diagram illustrating a first embodiment.

First, FIG. 1 is a hydraulic circuit diagram illustrating a first embodiment of a hydraulic control system for a hydraulic shovel in which the present invention is implemented. In FIG. 1, reference symbol A, B denotes a variable displacement hydraulic pumps; Aa, Ba denotes a displacement varying mean for varying the displacements of the hydraulic pumps A, B in response to a control signal from a controller 10 described below; reference numeral 3 denotes an oil tank; 4 denotes a left traveling motor; 5 denotes a right traveling motor; 6 denotes a boom cylinder; 7 denotes a swing motor; 8 denotes a stick cylinder; and 9 denotes a bucket cylinder.

The above-described left traveling motor 4, the right traveling motor 5, the boom cylinder 6, the swing motor 7, the stick cylinder 8, and the bucket cylinder 9 serve as hydraulic actuators whose hydraulic supply sources are the hydraulic pumps A, B. Among these hydraulic actuators, the boom cylinder 6 and the stick cylinder 8 serve as hydraulic actuators whose hydraulic supply sources are both the hydraulic pumps A, B. The boom cylinder 6, the stick cylinder 8, the bucket cylinder 9 serves as a hydraulic cylinder that performs extension and contraction action so as to cause a boom, a stick, a bucket (all not illustrated) each constituting a front working implement of the hydraulic shovel to swing. The left traveling motor 4, the right traveling motor 5 serves as a hydraulic motor that operates so as to cause the left and right traveling structures of the hydraulic shovel to drive forward and backward, respectively, and the swing motor 7 serves as a hydraulic motor that operates so as to cause an upper swing structure of the hydraulic shovel to swing rightward and leftward.

The hydraulic pump A is fluidly connected to a pump line C via a straight-travel valve 11 at a first position X, which will be discussed below, and is also fluidly connected to a left traveling directional switching valve 13. On the other hand, the hydraulic pump B is fluidly connected to a pump line D, and is also fluidly connected to a right traveling directional switching valve 14 via the straight-travel valve 11 at the first position X.

The straight-travel valve 11 is a two-position switching valve that switches between the first position X and the second position Y in response to a control signal output from the controller 10. In a state where the straight-travel valve 11 is positioned at the first position X, a discharged oil of the hydraulic pump A is supplied to the pump line C and the left traveling directional switching valve 13, and a discharged oil of the hydraulic pump B is supplied to the pump line D and the right traveling directional switching valve 14. In a state where the straight-travel valve 11 is positioned at the first position Y, the discharged oil of the hydraulic pump A is supplied to both the left and right traveling directional switching valves 13, 14, and the discharged oil of the hydraulic pump B is supplied to both the pump lines C and D. Then, the controller 10 controls the straight-travel valve 11 so as to be positioned at the first position X, when only left and right traveling operation levers (not illustrated), or when only other hydraulic actuators operation levers (operation levers for boom, for swing, for stick, for bucket, etc., all not illustrated) other than the traveling operation levers are operated. On the other hand, in case where both the left and right traveling operation levers are operated so as to perform straight-travel, and at the same time other hydraulic actuators operation levers are operated, the controller 10 outputs a control signal to cause the straight-travel valve 11 to be switched to the second position Y. Consequently, when only the left and right traveling operation levers are operated, the discharged oil of the hydraulic pumps A, B is supplied to the left and right traveling motors 4, 5 via the left and right traveling directional switching valves 13, 14 respectively, by the straight-travel valve 11 positioned at the first position X, and thus the supply flow rate to both the traveling motors 4, 5 can be equalized. On the other hand, when the left and right traveling operation levers and at the same time other hydraulic actuators operation levers are operated, the discharge flow rate of the hydraulic pump A can be shared only between the left and right traveling motors 4, 5 so that the supply flow rates to both the traveling motors 4, 5 can be equalized. In the following description, a case where the straight-travel valve 11 is positioned at the first position X, that is, a case where the discharged oil of the hydraulic pump A is supplied to the pump line C and the left traveling directional switching valve 13, and the discharged oil of the hydraulic pump B is supplied to the pump line D and the right traveling directional switching valve 14 will be discussed.

The left and right traveling directional switching valves 13, 14, which are spool valves of closed center type that control the supply and discharge flow rate to and from the left and right traveling motors 4, 5 as well as switch between the supply/discharge directions, include advancing-side, reversing-side pilot ports 13*a*, 13*b*, 14*a*, 14*b* fluidly connected to traveling solenoid proportional valves (though not illustrated, a left traveling advancing-side solenoid proportional valve, a left traveling reversing-side solenoid proportional valve, a right traveling advancing-side solenoid proportional valve, a right traveling reversing-side solenoid proportional valve) which output pilot pressures in response to control signals output from the controller 10. The left and right traveling directional switching valves 13, 14 are configured to be positioned at a neutral position N where not to perform the supply and discharge control to and from the left and right traveling motors 4, 5 in a state where no pilot pressure is input to both the advancing-side, reversing-side pilot ports 13*a*, 13*b*, 14*a*, 14*b*, but to be switched to an advancing-side actuation position X by a pilot pressure being input to the advancing-side pilot ports 13*a*, 14*a*, to open supply valve passages 13*e*, 14*e* for supplying the discharged oil of the hydraulic pump A, the hydraulic pump B to the advancing-side ports 4*a*, 5*a* of the left traveling motor 4, the right traveling motor 5; as well as to open discharge valve passages 13*f*, 14*f* which allow discharged oil from reversing-side ports 4*b*, 5*b* to flow into the oil tank 3, and also to be switched to a reversing-side actuation position Y by a pilot pressure being input to the reversing-side pilot ports 13*b*, 14*b*, to open the supply valve passages 13*e*, 14*e* for supplying the discharged oil of the hydraulic pump A, the hydraulic pump B to the reversing-side ports 4*b*, 5*b* of the left traveling motor 4, the right traveling motor 5; as well as to open the discharge valve passages 13*f*, 14*f* which allow discharged oil from the advancing-side ports 4*a*, 5*a* to flow into the oil tank 3. Then, the supply flow rate and the discharge flow rate to and from the left traveling motor 4, the right traveling motor 5 when positioned at the advancing-side actuation position X or the reversing-side actuation position Y are controlled in accordance with opening areas of the supply valve passages 13*e*, 14*e*, the discharge valve passages 13*f*, 14*f*; as well as the opening areas are controlled to increase or decrease depending on a spool stroke amount associated with increase or decrease of pilot pressures output to the advancing-side or reversing-side pilot ports 13*a*, 13*b*, 14*a*, 14*b* from the traveling solenoid proportional valves. Then, when left and right traveling operation levers are operated, the controller 10 is adapted to control the traveling solenoid proportional valve so as to output a pilot pressure that increases or decreases depending on an operation amount of the traveling operation lever, and thereby the controller 10 is adapted to be capable of driving the left and right traveling motors 4, 5 at a speed corresponding to an operation amount of the traveling operation levers.

On the other hand, from the pump line C fluidly connected to the hydraulic pump A, a boom main-side supply oil passage 17, a stick sub-side supply oil passage 18, and a bucket supply oil passage 19 are branched and formed so as to be parallel with each other. Further, from the pump line D fluidly connected to the hydraulic pump B, a boom sub-side supply oil passage 20, a swing supply oil passage 21 and a stick main-side supply oil passage 22 are branched and formed so as to be parallel with each other. The boom main-side supply oil passage 17 and the boom sub-side supply oil passage 20 are oil passages that fluidly connect the hydraulic pumps A, B respectively to a pump port 23*p* of a boom directional switching valve 23, which will be discussed below. The stick main-side supply oil passage 22 and the stick sub-side supply oil passage 18 are oil passages that fluidly connect the hydraulic pumps B, A respectively to a pump port 25*p* of a stick directional switching valve 25. The swing supply oil passage 21 is an oil passage that fluidly connects the hydraulic pump B to a pump port 24*p* of a swing directional switching valve 24, and the bucket supply oil passage 19 is an oil passage that fluidly connects the hydraulic pump A to a pump port 26*p* of a bucket directional switching valve 26.

In the stick sub-side supply oil passage 18, there is disposed a stick flow rate control valve 28 that controls a supply flow rate from the hydraulic pump A to the stick directional switching valve 25, and in the boom sub-side supply oil passage 20, there is disposed a boom flow rate control valve 29 that controls a supply flow rate from the hydraulic pump B to the boom directional switching valve 23. The stick flow rate control valve 28, the boom flow rate control valve 29 are poppet valves that perform flow rate control by being pilot-operated by a stick flow rate control solenoid proportional valve 45, a boom flow rate control solenoid proportional valve 46 (illustrated in FIG. 3) that are activated in response to control signals output from the controller 10, and have a backflow prevention function, thereby being adapted to allow for the flow of oil from the hydraulic pumps A, B to the stick directional switching valve 25, the boom directional switching valve 23, but to block off the backflow.

On the other hand, in the boom main-side supply oil passage 17, the bucket supply oil passage 19, the swing supply oil passage 21, the stick main-side supply oil passage 22, there are disposed no flow rate control valves like the stick flow rate control valve 28, the boom flow rate control valve 29 described above, and the supply flow rate from the hydraulic pump A or the hydraulic pump B via the boom main-side supply oil passage 17, the bucket supply oil passage 19, the swing supply oil passage 21, the stick main-side supply oil passage 22 is supplied to the boom directional switching valve 23, the bucket directional switching valve 26, the swing directional switching valve 24, the stick directional switching valve 25 as it is without the flow rate being controlled. A check valves 30 is disposed in each of the boom main-side supply oil passage 17, the bucket supply oil passage 19, the swing supply oil passage 21, the stick main-side supply oil passage 22, and is adapted to allow for the flow of oil from the hydraulic pumps A, B into the boom directional switching valve 23, the bucket directional switching valve 26, the swing directional switching valve 24, the stick directional switching valve 25, but to block off the backflow.

Thus, pressurized oil from the hydraulic pump A via the boom main-side supply oil passage 17, and pressurized oil from the hydraulic pump B via the boom sub-side supply oil passage 20 can be supplied to the pump port 23*p* of the boom directional switching valve 23; as well as, the pressurized oil from the hydraulic pump B will be supplied to the boom directional switching valve 23 in a state where (including the shut-off state) its flow rate is controlled by the boom flow control valve 29 disposed in the boom sub-side supply oil passage 20. Also, the pressurized oil from the hydraulic pump B via the stick main-side supply oil passage 22, and the pressurized oil from the hydraulic pump A via the stick sub-side supply oil passage 18 can be supplied to the pump port 25*p* of the stick directional switching valve 25; as well as the pressurized oil from the hydraulic pump A is supplied to the stick directional switching valve 25 in a state where (including the shut-off state) its flow rate is controlled by the stick flow control valve 28 disposed in the stick sub-side supply oil passage 18.

Next, the boom, the swing, the stick, and the bucket directional switching valves 23 to 26 will be discussed below.

First, the swing and bucket directional switching valves 24, 26, supplied with pressurized oil from one of the hydraulic pumps A, B will be discussed. The swing directional switching valve 24, which is a closed center type spool valve that performs supply and discharge flow rate control to and from the swing motor 7 and switches between supply and discharge directions, includes left swing-side, right swing-side pilot ports 24*a*, 24*b* fluidly connected to left swing-side, right swing-side solenoid proportional valves 42*a*, 42*b* (illustrated in FIG. 3) that outputs a pilot pressure in response to a control signal that is output from the controller 10; a pump port 24*p* fluidly connected to the swing supply oil passage 21; a tank port 24*t* fluidly connected to a tank line T extending to the oil tank 3; one actuator port 24*c* fluidly connected to a left swing-side port 7*a* of the swing motor 7; and an another actuator port 24*d* fluidly connected to a right swing-side port 7*b* of the swing motor 7. Then, the swing directional switching valve 24 is configured to be positioned at a neutral position N where not to perform supply and discharge control to and from the swing motor 7, in a state where a pilot pressure is not input to both the left swing-side pilot port 24*a*, the right swing-side pilot port 24*b*, but to be switched to a left swing-side actuation position X by a pilot pressure being input to the left swing side pilot port 24*a*, to open a supply valve passage 24*e* extending from the pump port 24*p* to the one actuator port 24, and a discharge valve passage 24*f* extending from the another actuator port 24*d* to the tank port 24*t*; also to be switched to a right swing-side actuation position Y by a pilot pressure being input to the right swing-side pilot port 24*b*, to open a supply valve passage 24*e* extending from the pump port 24*p* to the another actuator port 24*d*, and a discharge valve passage 24*f* extending from the one actuator port 24*c* to the tank port 24*t*. Then, the supply flow rate and the discharge flow rate to and from the swing motor 7 when positioned at the left swing-side actuation position X or the right swing-side actuation position Y are controlled in accordance with an opening area of the supply valve passage 24*e*, the discharge valve passage 24*f* The opening area is controlled to increase or decrease depending on a spool stroke amount associated with an increase or decrease of a pilot pressure output from the left swing-side, right swing-side solenoid proportional valves 42*a*, 42*b* to the left swing-side, right swing-side pilot ports 24*a*, 24*b*.

The bucket directional switching valve 26, which is a closed center spool valve that controls supply and discharge flow rate to and from the bucket cylinder 9 and switches between the supply and discharge directions, includes extension-side, contraction-side pilot ports 26*a*, 26*b* fluidly connected to extension-side, contraction-side solenoid proportional valves 44*a*, 44*b* (illustrated in FIG. 3) that output pilot pressure in response to control signals output from the controller 10; a pump port 26*p* fluidly connected to the bucket supply oil passage 19; a tank port 26*t* fluidly connected to the tank line T; one actuator port 26*c* fluidly connected to ahead-side port 9*a* of the bucket cylinder 9; and an another actuator port 26*d* fluidly connected to a rod-side port 9*b* of the bucket cylinder 9. The bucket directional switching valve 26 having a structure similar to that of the swing directional switching valve 24 described above is configured to open a supply valve passage 26*e* extending from the pump port 26*p* to the actuator port 26*c* or 26*d*, and a discharge valve passage 26*f* extending from the actuator port 26*d* or 26*c* to the tank port 26*t*, when switched from a neutral position N to an extension-side actuation position X and a contraction-side actuation position Y. Then, the supply flow rate and the discharge flow rate to and from the bucket cylinder 9 are controlled in accordance with an opening area of the supply valve passage 26*e*, the discharge valve passage 26*f*, and the opening area is controlled to increase or decrease depending on a spool stroke amount associated with an increase or decrease of a pilot pressure output from the bucket side extension-side, contraction-side solenoid proportional valves 44*a*, 44*b*.

Figure 2:
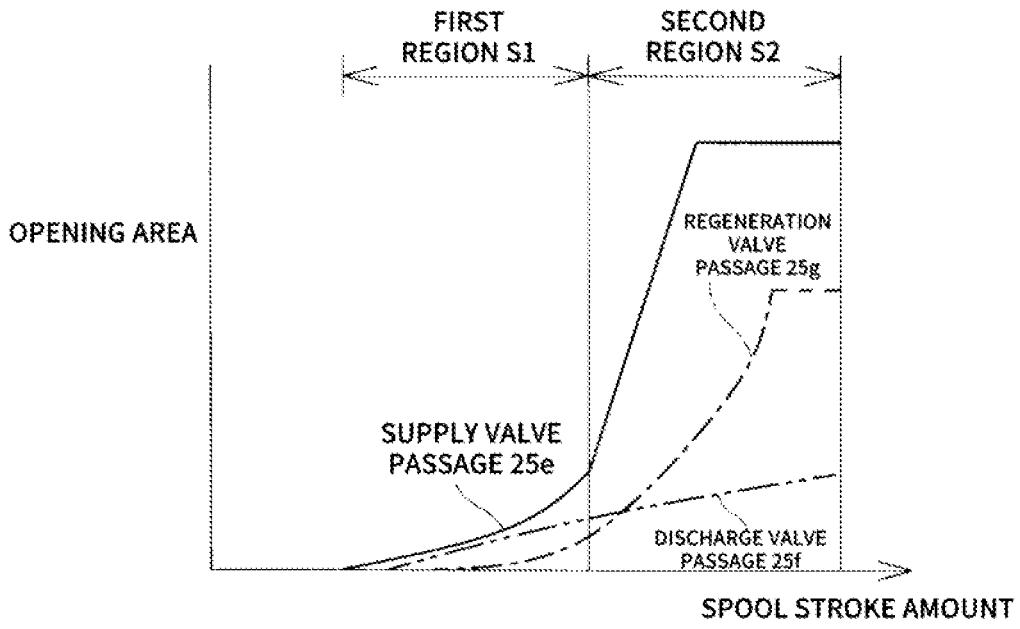
FIG. 2 is a diagram illustrating opening characteristics of a stick directional switching valve.

Next, the stick, boom directional switching valves 25, 23 supplied with the pressurized oil from both the hydraulic pumps A, B will be discussed. The stick directional switching valve 25, which is a closed center spool valve that performs supply and discharge flow rate control to and from the stick cylinder 8 (the supply flow rate control is not performed at a second region S2 in the latter half of the spool stroke, as will be discussed below,) and regeneration flow rate control as well as switches between the supply and discharge directions, includes extension-side, contraction-side pilot ports 25*a*, 25*b* fluidly connected to stick extension-side, contraction-side solenoid proportional valves 43*a*, 43*b* (illustrated in FIG. 3) that outputs a pilot pressure in response to control signals output from the controller 10; a pump port 25*p* fluidly connected to the stick main-side supply oil passage 22 and the stick sub-side supply oil passage 18; a tank port 25*t* fluidly connected to the tank line T; one actuator port 25*c* fluidly connected to a head-side port 8*a* of the stick cylinder 8; and an another actuator port 25*d* fluidly connected to a rod-side port 8*b* of the stick cylinder 8. Then, the stick directional switching valve 25 is configured to be positioned at a neutral position N where not to perform the supply and discharge control to and from the stick cylinder 8, in state where a pilot pressure is not input to both the extension-side, contraction-side pilot ports 25*a*, 25*b*, but to be switched to an extension-side actuation position X by a pilot pressure being input to the extension-side pilot port 25*a*, to open a supply valve passage 25*e* extending from the pump port 25*p* to the one actuator port 25*c*, and a discharge valve passage 25*f* extending from the other actuator port 25*d* to the tank port 25*t*; as well as to open a regeneration valve passage 25*g* for supplying a part of discharged oil from the another actuator port 25*d* to the one actuator port 25*c* as a regenerated oil, and also to be switched to a contraction-side actuation position Y by a pilot pressure being input to the contraction-side pilot port 25*b*, to open the supply valve passage 25*e* extending from the pump port 25*p* to the other actuator port 25*d* and the discharge valve passage 25*f* extending form the one actuator port 25*c* to the tank port 25*t*. The opening area of the supply valve passage 25*e*, the discharge valve passage 25*f*, the regeneration valve passage 25*g* increases or decreases depending on a stroke amount of the spool which is moved by a pilot pressure output from the stick extension-side, contraction-side solenoid proportional valves 43*a*, 43*b*. In this case, however, the discharge valve passage 25*f* and the regeneration valve passage 25*g* are adapted to perform flow rate control of the discharge flow rate and the regeneration flow rate in accordance with the opening area of the discharge valve passage 25*f*, the regeneration valve passage 25*g* over the entire range of the spool stroke amount (both regions of a first region S1 and a second region S2 described below). On the other hand, the supply valve passage 25*e* is adapted to control the supply flow rate from the pump port 25*p* to the actuator port 25*c* or 25*d* in accordance with the opening area of the supply valve passage 25*e*, at the first region S1 of the former half of the spool stroke, which is a small side of the spool stroke amount, but to supply the flow rate input from the pump port 25*p* to the actuator port 25*c* or 25*d* as it is without controlling the flow rate, at the second region S2 of the latter half of the spool stroke, which is a large side of the spool stroke, where the opening area of the supply valve passage 25*e* is set wider than that when the supply flow rate control is performed (refer to FIG. 2).

The boom directional switching valve 23, which is a closed center spool valve that performs supply and discharge flow rate control to and from the boom cylinder 6 (the supply flow rate control is not performed at the second region S2 of the latter half of the spool stroke, similarly to the stick directional switching valve 25) and a regeneration flow rate control, and switches between the supply and discharge directions, includes extension-side, contraction side pilot ports 23*a*, 23*b* fluidly connected to boom extension-side, contraction-side solenoid proportional valves 41*a*, 41*b* (illustrated in FIG. 3) which outputs a pilot pressure in response to control signals output from the controller 10; a pump port 23*p* fluidly connected to the boom main-side supply oil passage 17 and the boom sub-side supply oil passage 20; a tank port 23*t* fluidly connected to the tank line T; one actuator port 23*c* fluidly connected to a head-side port 6*a* of the boom cylinder 6, and an another actuator port 23*d* fluidly connected to a rod-side port 6*b* of the boom cylinder 6. The boom directional switching valve 23, which has a structure similar to that of the stick directional switching valve 25 described above, is configured to open a supply valve passage 23*e* extending from the pump port 23*p* to the actuator port 23*c* or 23*d*, and a discharge valve passage 23*f* extending from the actuator port 23*d* or 23*c* to the tank port 23*t*, by switching from a neutral position N to an extension-side actuation position X, a contraction-side actuation position Y, furthermore, to open a regeneration valve passage 23*g* that supplies a part of the discharged oil from the one actuator port 23*c* to the another actuator port 23*d* as a regenerated oil at the contraction-side actuation position Y. Then, similarly to the stick directional switching valve 25, the discharge valve passage 23*f* and the regeneration valve passage 23*g* are adapted to perform the flow rate control of the discharge flow rate and regeneration flow rate in accordance with an opening area of the discharge valve passage 23*f*, the regeneration valve passage 23*g* over the entire range of the spool stroke amount; however, the supply valve passage 23*e* is adapted to control a supply flow rate from the pump port 23*p* to the actuator port 23*c* or 23*d* in accordance with an opening area of the supply valve passage 23*e*, at the first region S1 of the former half of the spool stroke, and to supply a pump flow rate to be input from the pump port 23*p* to the actuator port 23*c* or 23*d* as it is without performing flow rate control, at the second region S2 of the latter half of the spool stroke.

Moreover, in FIG. 1, E, F denote bleed lines which are branched and formed from upstream side positions of all the directional switching valves 13, 14, 23 through 26 fluidly connected to the pump lines C, D and extend to the tank line T. Bleed valves 31, 32 are disposed in the bleed lines E, F, respectively. These bleed valves 31, 32 are adapted to be actuated by a pilot pressure output from bleed solenoid proportional valves 47*a*, 47*b* (illustrated in FIG. 3), to control to increase or decrease a bleed flow rate of oil flowing from the hydraulic pumps A, B via the bleed lines E, F into the oil tank 3, but the above-described bleed solenoid proportional valves 47*a*, 47*b* is adapted to control to increase or decrease a pilot pressure output to the bleed valves 31, 32, in response to a control signal output from the controller 10.

Figure 3:
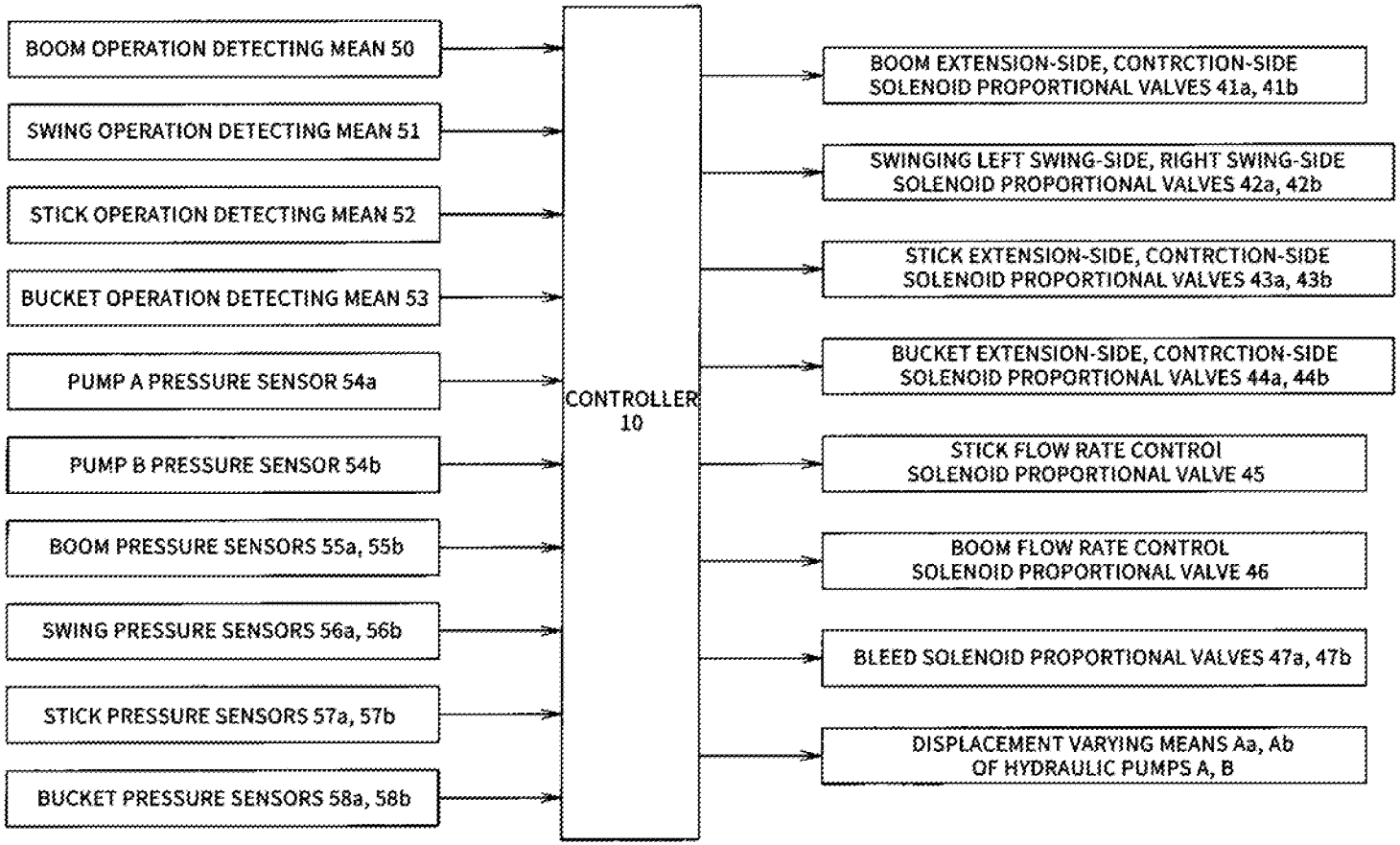
FIG. 3 is a block diagram illustrating an input and output of a controller.

On the other hand, the controller 10 (corresponding to a control means and a pump control means of the present invention), as illustrated in the block diagram of FIG. 3, is configured to receive signals input from a boom operation detecting mean 50 for detecting an operation direction and an operation amount of a boom operation lever; a swing operation detecting mean 51 for detecting an operation direction and an operation amount of a swing operation lever; a stick operation detecting mean 52 for detecting an operation direction and an operation amount of a stick operation lever; a bucket operation detecting mean 53 for detecting an operation direction and an operation amount of a bucket operation lever; a pump A pressure sensor 54*a* for detecting a discharge pressure of the hydraulic pump A; a pump B pressure sensor 54*b* for detecting a discharged pressure of the hydraulic pump B; boom pressure sensors 55*a*, 55*b* for detecting a load pressure on head-side, rod-side of the boom cylinder 6 respectively; swing pressure sensors 56*a*, 56*b* for detecting a load pressures on left swing-side, right swing-side of the swing motor 7 respectively; stick pressure sensors 57*a*, 57*b* for detecting load pressures of on head-side, rod-side of the stick cylinder 8 respectively; bucket pressure sensors 58*a*, 58*b* for detecting load pressures on head-side, rod-side of the bucket cylinder 9 respectively, etc., to output control signals in response to these input signals, to boom extension-side, contraction-side solenoid proportional valves 41*a*, 41*b*; swinging left swing-side, right swing-side solenoid proportional valves 42*a*, 42*b*; stick extension-side, contraction-side solenoid proportional valves 43*a*, 43*b*; bucket extension-side, contraction-side solenoid proportional valve 44*a*, 44*b* that outputs pilot pressures to the pilot ports 23*a*, 23*b* through 26*a*, 26*b* of the boom, swing, stick, bucket directional switching valves 23 through 26 respectively; a stick flow rate control solenoid proportional valve 45 that outputs a pilot pressure to the stick flow rate control valve 28 disposed in the stick sub-side supply oil passage 18; a boom flow rate control solenoid proportional valve 46 that outputs a pilot pressure to the boom flow rate control valve 29 disposed in the boom sub-side supply oil passage 20; bleed solenoid proportional valves 47*a*, 47*b* that output pilot pressures to the bleed valves 31, 32; displacement varying means AA, Ba of the hydraulic pumps A, B, etc., and to perform oil supply and discharge control to and from the boom cylinder 6, the swing motor 7, the stick cylinder 8, the bucket cylinder 9, flow rate control of the bleed lines E, F and discharge flow rate control of the hydraulic pumps A, B, etc. The controller 10 performs the switching control of the straight-travel valve discussed above, and the oil supply and discharge control to and from the right and left traveling motors 4, 5, but discussion of these controls will be omitted hereunder.

Next, the controls performed by the controller 10 will be discussed.

The controller 10, upon receiving detection signals input from each one of boom, swing, stick, bucket operation detecting means 50 through 53, determines a target discharge flow rate so as to increase the discharge flow rate of the hydraulic pumps A, B with increasing operation amount of the operation lever, in response to these detection signals, and outputs control signals to the displacement varying means Aa, Ba of the hydraulic pumps A, B so that the target discharge flow rate can be obtained. In this case, the discharge flow rate of the hydraulic pumps A, B is individually controlled, depending on the hydraulic pumps A, B acting as a hydraulic supply source of a hydraulic actuator to be operated.

Moreover, the controller 10, upon receiving detection signals input from each one of boom, swing, stick, bucket operation detecting means 50 through 53, outputs control signals to the bleed solenoid proportional valves 47*a*, 47*b* to control the bleed valves 31, 32, so as to decrease bleed flow rates (including zero bleed flow rate) flowing from the hydraulic pumps A, B to the oil tank 3 with increasing operation amount of the operation lever, in response to these detection signals. In this case, the bleed flow rate of the bleed lines E, F is individually controlled, depending on the hydraulic pumps A, B acting as the hydraulic supply source of the operated hydraulic actuator.

Moreover, the controller 10, upon receiving detection signals input from each one of boom, swing, stick, bucket operation detecting means 50 through 53, determines a target supply flow rate for the boom cylinder 6, the swing motor 7, the stick cylinder 8, the bucket cylinder 9, in accordance with an operation amount of each operation lever. Then, the controller 10 outputs control signals for pilot pressure output to solenoid proportional valves 41*a*, 41*b* through 44*a*, 44*b*, 45, 46 for the corresponding hydraulic actuator, so that the target supply flow rate be supplied to the boom cylinder 6, the swing motor 7, the stick cylinder 8, the bucket cylinder 9. In this case, as for the swing motor 7, the bucket cylinder 9 of which hydraulic supply source is either one of the hydraulic pumps A, B, the control signals are output to the swinging left swing-side, right swing-side solenoid proportional valves 42*a*, 42*b*, the bucket extension-side, contraction-side solenoid proportional valves 44*a*, 44*b* so that supply valve passages 24*e*, 26*e* of the swing directional switching valve 24, the bucket directional switching valve 26 have the opening areas corresponding to the target supply flow rates. In this case, the discharge flow rate control is also performed in accordance with the opening areas of the discharge valve passages 24*f*, 26*f*, depending on the spool stroke positions for performing the supply flow rate control in accordance with the opening areas of the supply valve passages 24*e*, 26*e*.

As for the boom cylinder 6, the stick cylinder 8 whose hydraulic supply source is both the hydraulic pumps A, B, the controller 10, in case where only the supply flow rate from the hydraulic pump A or the hydraulic pump B fluidly connecting the boom, stick main-side supply oil passages 17, 22 thereto is sufficient for a target supply flow rate, outputs a control signal to the boom extension-side, contraction-side solenoid proportional valves 41*a*, 41*b*, the stick extension-side, contraction-side solenoid proportional valves 43*a*, 43*b* so that the spool of the boom directional switching valve 23 and the stick directional switching valve 25 be positioned at a first region S1 at which the supply flow rate is controlled in accordance with an opening area of the supply valve passages 23*e*, 25*e*, and be positioned at a spool stroke position at which an opening area of the supply valve passages 23*e*, 25*e* is equal to an opening area corresponding to the target supply flow rate. In this case, a discharge flow rate control in accordance with an opening area of discharge valve passages 23*f*, 25*f* and a regeneration flow rate control in accordance with the opening area of regeneration valve passages 23*g*, 25*g* are also performed, depending on spool stroke positions for performing the supply flow rate control in accordance with the opening area of the supply valve passages 23*e*, 25*e*. Moreover, in case where only the supply flow rate from the hydraulic pump A or the hydraulic pump B is sufficient the target supply flow rate, the controller 10 outputs control signals to the boom flow rate control solenoid proportional valve 46 and the stick flow rate control solenoid proportional valve 45 so as to close the boom flow rate control valve 29 disposed in the boom sub-side supply oil passage 20 and the stick flow rate control valve 28 disposed in the stick sub-side supply oil passage 18. Consequently, only the supply flow rate from the hydraulic pumps A or B fluidly connected to the boom main-side supply oil passage 17, the stick main-side supply oil passage 22 is supplied to the boom cylinder 6 and the stick cylinder 8, whose supply flow rate is controlled by the boom directional switching valve 23, the stick directional switching valve 25.

On the other hand, when the target supply flow rate requires the flow rate from both the hydraulic pumps A, B, the controller 10 outputs control signals to the boom extension-side, contraction-side solenoid proportional valves 41*a*, 41*b*, and the stick extension-side, contraction-side solenoid proportional valves 43*a*, 43*b* so that the spool of the boom directional switching valve 23 and the stick directional switching valve 25 be positioned at a second region S2 where a flow rate input from the pump ports 23*p*, 25*p* is supplied to the boom cylinder 6, the stick cylinder 8 as it is, and be positioned at a spool stroke position corresponding to the operation amount of the operation lever. In this case, since the boom directional switching valve 23 and the stick directional switching valve 25 are positioned at the second range S2, the supply flow rate control is not performed, but the discharge flow rate control and the regeneration flow rate control are performed in accordance with the opening areas of the discharge valve passages 23*f*, 25*f*, and the regeneration valve passages 23*g*, 25*g* which increase or decrease depending on a spool stroke amount. Moreover, in case where the target supply flow rate requires the flow rate from both the hydraulic pumps A, B, the controller 10 outputs control signals to the boom flow rate control solenoid proportional valve 46, the stick flow rate control solenoid proportional valve 45, and controls so that the supply flow rate from the boom flow rate control valve 29, the stick flow rate control valve 28 to the boom directional switching valve 23, the stick directional switching valve increases with increasing target supply flow rate (with increasing operation amount of the operation lever). In this case, the controller 10 controls the boom flow rate control valve 29, the stick flow rate control valve 28 so that a total flow rate of the supply flow rate from the hydraulic pump A or the hydraulic pump B supplied from the boom main-side supply oil passage 17, the stick main-side supply oil passage 22, and the control flow rate of the hydraulic pump B or the hydraulic pump A, whose flow rate is controlled by the boom flow control valve 29, the stick flow control valve 28 disposed in the boom sub-side supply oil passage 20, the stick sub-side is equivalent to the target supply flow rate. Consequently, the total flow rate of the supply flow rate from the hydraulic pump A or hydraulic pump B fluidly connected to the boom main-side supply oil passage 17, the stick main-side supply oil passage 22, and the controlled flow rate of the hydraulic pump B or hydraulic pump A, whose flow rate is controlled by the boom flow control valve 29, the stick flow control valve 28 is supplied to the boom cylinder 6, the stick cylinder 8 via the supply valve passages 23*e*, 25*e* of the boom directional switching valve 23, the stick directional switching valve 25; as well as the supply flow rate to the boom cylinder 6, the stick cylinder 8 is controlled to increase or decrease by the boom flow control valve 29, the stick flow control valve 28.

In the present embodiment, the boom cylinder 6, the stick cylinder 8 serves as a hydraulic actuator whose hydraulic supply source is both the hydraulic pumps A, B, and corresponds to a first hydraulic actuator of the present invention. The boom directional switching valve 23, the stick directional switching valve 25 corresponds to a directional switching valve for the first hydraulic actuator of the present invention. The boom flow rate control valve 29, the stick flow rate control valve 28 corresponds to a flow rate control valve for the first hydraulic pump of the present invention, but the first hydraulic pump of the present invention is a hydraulic pump to which the main-side supply oil passage is connected, and a second hydraulic pump is a hydraulic pump to which the sub-side supply oil passage is connected. When the boom cylinder 6 is used as the first hydraulic actuator of the present invention, the hydraulic pump A becomes the first hydraulic pump, and the hydraulic pump B becomes the second hydraulic pump. When the stick cylinder 7 is used as the first hydraulic actuator of the present invention, the hydraulic pump B becomes the first hydraulic pump and the hydraulic pump A becomes the second hydraulic pump.

Now, a pump discharge flow rate control by the controller 10, and the controls of the stick flow rate control valve 28 and the stick directional switching valve 25 in case where the stick operation lever is independently operated to an extension-side (stick-in side) will be discussed in detail.

Figure 4:
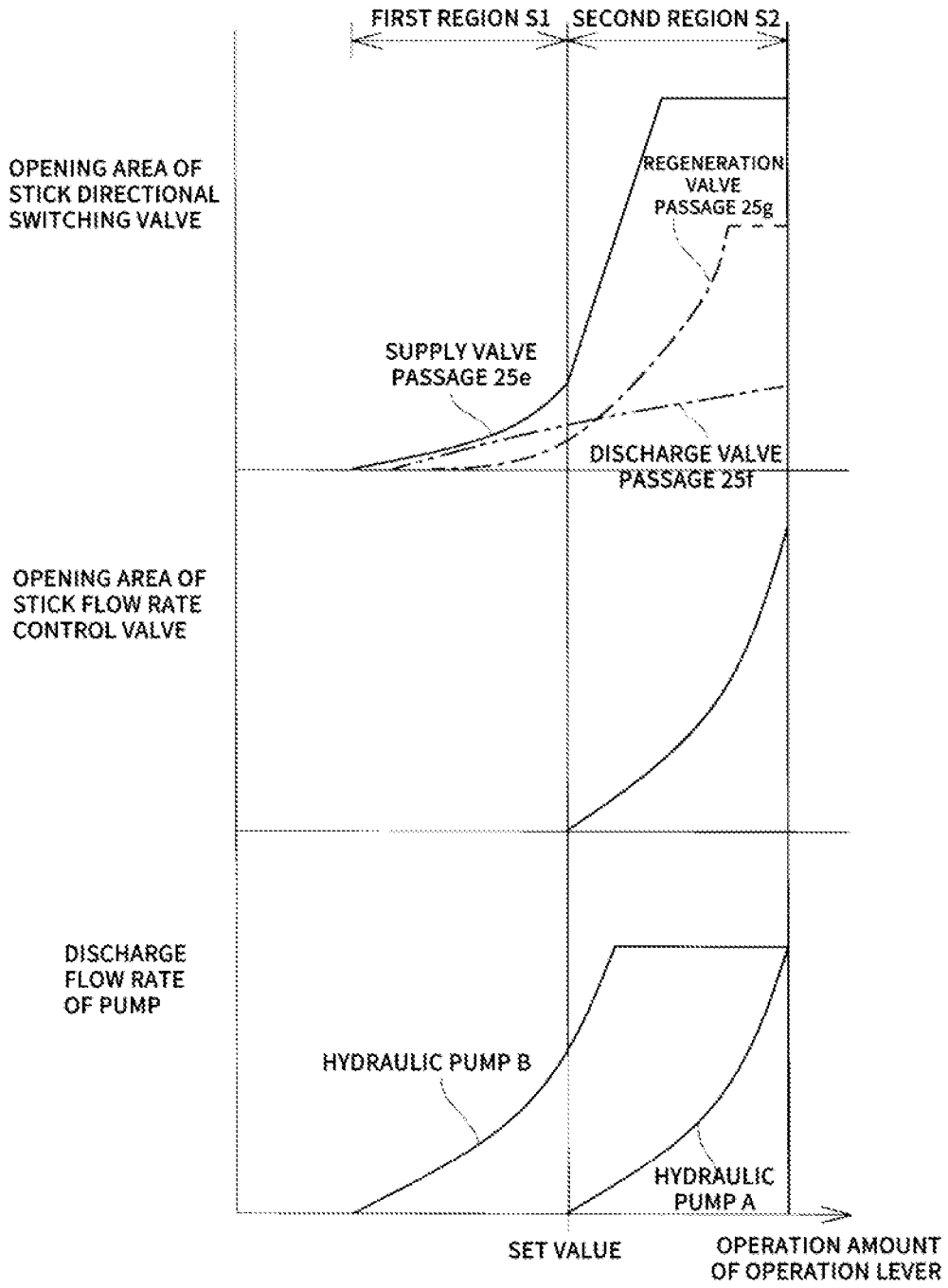
FIG. 4 is a diagram illustrating relationships between an operation amount of an operation lever when a stick operation lever is operated independently and discharge flow rates of hydraulic pumps, an opening area of a stick flow rate control valve, an opening area of a stick directional switching valve.
Figure 5:
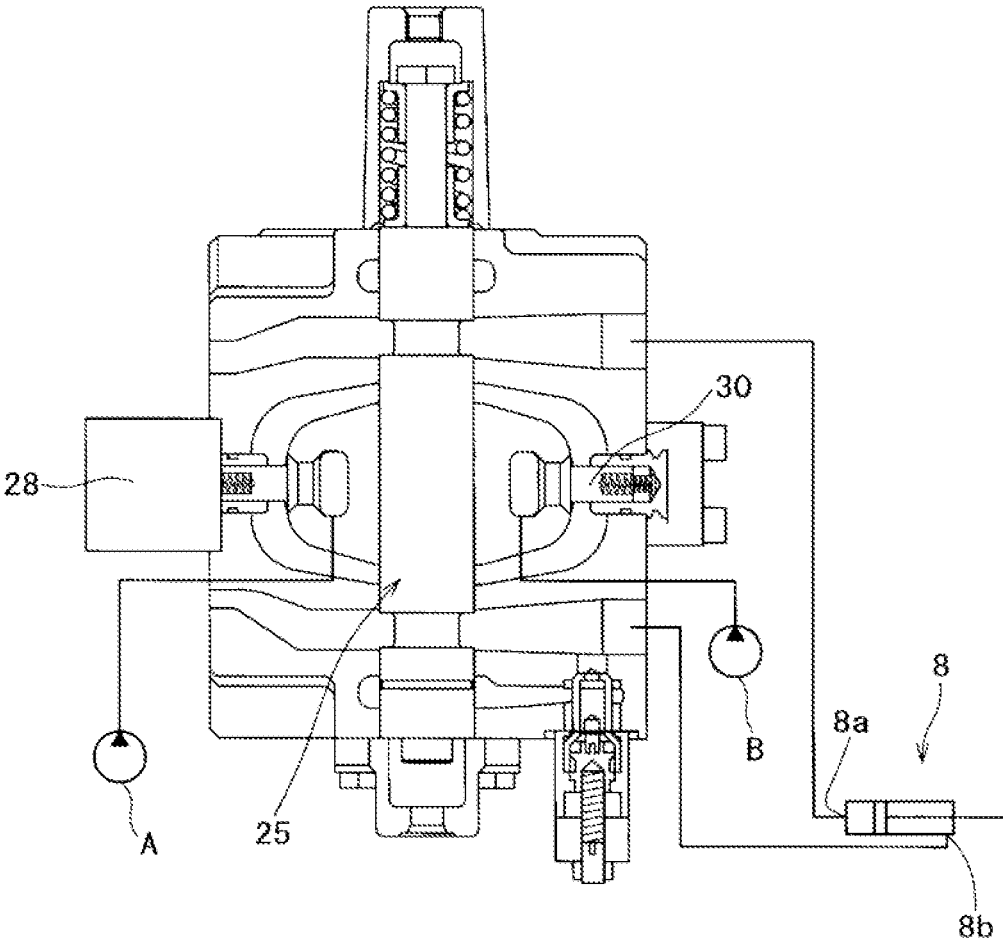
FIG. 5 is a view illustrating a state in which the stick directional switching valve and the stick flow control valve are incorporated.

First, when the stick operation lever is independently operated to the extension-side, the controller 10 controls the discharge flow rates of the hydraulic pumps A, B in accordance with the operation amount of the operation lever. In this case, if the operation amount of the operation lever is less than a set value that is previously set, the controller 10 controls so as to increase the discharge flow rate of the hydraulic pump B from a minimum flow rate to a maximum vicinity flow rate with increasing operation amount of the operation lever, on the other hand, holds the flow rate of the hydraulic pump A at the minimum flow rate. Then, when the operation amount of the operation lever becomes greater than or equal to the set value, the controller 10 further increases the discharge flow rate of the hydraulic pump B to reach the maximum flow rate; on the other hand, increases the discharge flow rate of the hydraulic pump A with increasing operation amount of the operation lever (See FIG. 4).

Moreover, the controller 10 outputs a control signal to the stick flow rate control solenoid proportional valve 45 in order to control a flow rate of the stick flow rate control valve 28 disposed in the stick sub-side supply oil passage 18 in accordance with the operation amount of the operation lever. In this case, when the operation amount of the operation lever is less than the set value, the controller 10 controls so as to close the stick flow rate control valve 28; on the other hand, when the operation amount of the operation lever becomes greater than or equal to the set value, the controller 10 controls so that the supply flow rate from the stick flow rate control valve 28 to the directional switching valve 25 increases with increasing operation amount of the operation lever (see FIG. 4). Consequently, when the operation amount of the operation lever is less than the set value, only the discharge flow rate of the hydraulic pump B via the stick main-side supply oil passage 22 is supplied to the pump port 25*p* of the stick directional switching valve 25. On the other hand, when the operation amount of the operation lever become greater than or equal to the set value, a total flow rate of the discharge flow rate of the hydraulic pump B and the controlled flow rate of the hydraulic pump A controlled by the stick flow rate control solenoid proportional valve 45 is supplied to the pump port 25*p*.

Moreover, the controller 10 outputs a control signal to the stick extension-side solenoid proportional valve 43*a* so as to output a pilot pressure in accordance with the operation amount of the operation lever, and thereby the stick directional switching valve 25 switches to an extension-side actuation position X when the spool is moved, but a spool stroke amount of the stick directional switching valve 25 is set so as to be positioned at the first region S1 where a supply flow rate from the pump port 25*p* to the actuator port 25*c* is controlled in accordance with an opening area of the supply valve passage 25*e*, when the operation amount of the operation lever is less than the set value which has been previously set; and is set so as to be positioned at the second region S2 where the flow rate input to the pump port 25*p* is supplied to the actuator port 25*c* as it is without performing the flow rate control, when the operation amount of the operation lever is greater than or equal to the set value. Consequently, when the operation amount of the stick operation lever is less than the set value, the supply flow rate to the stick cylinder 8 is controlled to increase or decrease in accordance with the opening area of the supply valve passage 25*e* that increases or decreases depending on the spool stroke amount associated with the increase or decrease in the operation amount of the operation lever. On the other hand, when the operation amount of the operation lever is greater than or equal to the set value, the flow rate input to the pump port 25*p* of the stick directional switching valve 25 is supplied to the stick cylinder 8 as it is. The flow rate input to the pump port 25*p* of the stick directional switching valve 25 when the operation amount of the operation lever is greater than or equal to the set value, corresponds to the total flow rate of the discharge flow rate of the hydraulic pump B and the controlled flow rate of the hydraulic pump A whose flow rate is controlled by the stick flow rate control valve 28 as described above. Therefore, when the operation amount of the operation lever is greater than or equal to the set value, the supply flow rate to the stick cylinder 8 can be controlled to increase or decrease, in accordance with the control flow rate of the hydraulic pump A whose flow rate is controlled by the stick flow rate control solenoid proportional valve 45. On the other hand, the discharge valve passage 23*f* and the regeneration valve passage 23*g* of the stick directional switching valve 23 are adapted to be controlled to increase or decrease the supply flow rate to the stick cylinder 8 depending on the increase or decrease of the spool stroke amount associated with the increase or decrease in the operation amount of the operation lever, and thereby the regeneration flow rate control and the discharge flow rate control corresponding to the increase or decrease in the operation amount of the operation lever are performed.

In the present embodiment configured as described above, a hydraulic control system for a hydraulic shovel includes the hydraulic pumps A, B; the boom cylinder 6, the stick cylinder 8 whose hydraulic supply source is these hydraulic pumps A, B; the swing motor 7, the bucket cylinder 9 whose pressurized oil supply source is one of the hydraulic pumps A, B, etc. Taking the stick cylinder 8 as an example because of the same control in performing supply and discharge flow rate control to and from the boom cylinder 6, the stick cylinder 8 whose hydraulic supply source is both the hydraulic pumps A, B, the hydraulic control system includes the stick directional switching valve 25 having the supply valve passage 25*e* and the discharge valve passage 25*f* to and from the stick cylinder 8 as well as switching between the supply/discharge directions; the stick main-side supply oil passage 22, the stick sub-side supply oil passage 18 connecting the hydraulic pumps B, A to the pump ports 25*p* of the stick directional switching valve 25 respectively; the stick flow rate control valve 28 disposed in the stick sub-side supply oil passage 18, for controlling the supply flow rate from the hydraulic pump A to the stick directional switching valve 25; and the controller 10 for electronically controlling the stick directional switching valve 25 and the stick flow rate control valve 28, and is configured such that, in a state where the stick flow control valve 28 is closing the stick sub-side supply oil passage 18, only the supply flow rate from the hydraulic pump B via the stick main-side supply oil passage 22 is supplied to the stick directional switching valve 25, and in a state where the stick flow rate control valve 28 is opening the stick sub-side supply oil passage 18, the controlled flow from the hydraulic pump A, whose flow rate is controlled by the stick flow rate control valve 28 and the supply flow rate from the hydraulic pump B are supplied to the stick directional switching valve 25. On the other hand, the stick directional switching valve 25 is a spool valve of which the spool is moved in proportion to the operation amount of the stick operation lever, and is configured to perform the supply flow rate control in accordance with the opening area of the supply valve passage 25*e* which increases or decreases depending on a spool stroke amount, at the first region S1 of the former half of the spool stroke, and to supply the flow rate input to the pump port 25*p* to the stick cylinder 8 as it is without performing the supply flow rate control, since the opening area of the supply valve passage 25*e* is set wider than that when performing the supply flow rate control, at the second region S2 of the latter half of the spool stroke, further to perform the discharge flow rate control in accordance with the opening area of the discharge valve passage 25*f* that increases or decreases depending on the spool stroke amount in both the first and second regions S1 and S2. Then, when only the supply flow rate from the hydraulic pump B is sufficient for the supply flow rate to the stick cylinder 8, the controller 10 closes the stick sub-side supply oil passage 18 by the stick flow rate control valve 28, as well as causes the spool of the stick directional switching valve 25 to be positioned at the first region S1, so as to perform the supply flow rate control from the hydraulic pump B to the stick cylinder 8 in accordance with the opening area of the supply valve passage 25*e* of the stick directional switching valve 25; on the other hand, when the flow rate to the stick cylinder 8 requires the flow rate from both the hydraulic pumps B, A, the controller 10 controls the stick flow rate control valve 28 such that the supply flow rate from the hydraulic pump A to the stick directional switching valve 25 increases in proportion to the operation amount of the stick operation lever, and causes the spool of the stick directional switching valve 25 to be positioned at the second region S2, and thereby a total flow rate of the controlled flow rate from the hydraulic pump A which is controlled by the stick flow rate control valve 28 and the supply flow rate from hydraulic pump B are supplied to the stick cylinder 8 via the supply valve passage 25*e* of the stick directional switching valve 25.

As a result, while achieving the reduction of the number of parts and simplification of circuit structure by using only one of the directional switching valve 23, 25 for the boom cylinder 6, the stick cylinder 8 whose hydraulic supply source is both the hydraulic pumps A, B, the configuration is such that, when only a supply flow rate from the hydraulic pumps A, B is sufficient for a supply flow rate to the boom cylinder 6, the stick cylinder 8, only the supply flow rate from the hydraulic pumps A, B is supplied to the boom directional switching valve 23, the stick directional switching valve 25, and when the supply flow rate to the boom cylinder 6, the stick cylinder 8 requires the supply flow rates from both of the hydraulic pumps A, B, the controlled flow rate of another hydraulic pumps B, A whose flow rate is controlled by the boom flow rate control valve 29, the stick flow rate control valve 28 and the supply flow rate from the one of hydraulic pumps A, B is supplied to the boom directional switching valve 23, the stick directional switching valve 25. Therefore, a necessary and sufficient flow rate is supplied to the boom directional switching valve 23, the stick directional switching valve 25, and the discharge flow rates of the hydraulic pumps A, B can be used without waste. On top of that, with this hydraulic control system, in a large flow rate range in which the supply flow rate from both the hydraulic pumps A, B is required, the supply flow rate to the boom cylinder 6, the stick cylinder 8 is controlled to increase or decrease in accordance with the flow rates supplied from the boom flow rate control valve 29, the stick flow rate control valve 28 to the boom directional switching valve 23, the stick directional switching valve 25, on the other hand, the discharge flow rate from the boom cylinder 6, the stick cylinder 8 is controlled to increase or decrease in accordance with the opening area of the discharge valve passages 23*f*, 25*f* of the boom directional switching valve 23, the stick directional switching valve 25, and thereby it has come to be possible to individually perform the supply flow rate control and the discharge flow rate control, and in-turn it is possible to change a relationship between the supply flow rate and the discharge flow rate with respect to the operation amount of the operation lever depending on various work contents; or it is possible to control an opening area of the boom flow rate control valve 29, the stick flow rate control valve 28 which performs the supply flow rate control, in accordance with the operation amount of the operation lever and a pressure difference between the discharge pressure of the hydraulic pumps A, B and oil inflow side load pressure of the boom cylinder 6, the stick cylinder 8; and further to control an opening area of the discharge valve passages 23*f*, 25*f* of the boom directional switching valve 23, the stick directional switching valve 25 which performs the discharge flow rate control, in accordance with the operation amount of the operation lever and an oil outflow side load pressure of the boom cylinder 6, the stick cylinder 8. Then, although it is possible to improve operability and work efficiency, by making it possible in this manner to individually perform the supply flow rate control and the discharge flow rate control in the range of such a large flow rate, it is possible to omit a flow rate control valve for the main-side supply oil passage and a solenoid proportional valve which pilot-operates the flow rate control valve, by also performing the supply flow rate control by the boom directional switching valve 23, the stick directional switching valve 25, in a flow rate range in which the supply flow rate from the one of hydraulic pumps A, B is sufficient, thereby enabling contribution to the reduction of the number of parts and simplification of circuit structure, besides the reduction of costs.

Moreover, in this hydraulic control system, the controller 10 is configured to control the discharge flow rate of the hydraulic pumps A, B in accordance with an operation amount of the hydraulic actuator operation lever, but the discharge flow rate control of the hydraulic pumps A, B, when only the boom operation lever or the stick operation lever is operated without other hydraulic actuators operation levers being operated, will be performed in a similar way. Therefore, taking a case where only the stick operation lever is operated as an example, when the operation amount of the operation lever is less than the set value, the controller 10 increases the discharge flow rate of the hydraulic pump B to which the stick main-side supply oil passage 22 is connected in proportion to the operation amount of the operation lever; on the other hand, when the discharge flow rate of the hydraulic pump A which is fluidly connected to the stick sub-side supply oil passage 18 is kept at a minimum flow rate and the operation amount of the stick operation lever is greater than or equal to the set value, the controller 10 further increases the discharge flow rate of the hydraulic pump B in proportion to the operation amount of the operation lever; on the other hand, the controller 10 increases the discharge flow rate of the hydraulic pump A in proportion to the operation amount of the operation lever. As a result, it becomes possible to supply the discharge flow rates of the hydraulic pumps B, A to the stick directional switching valve 25 and the stick flow control valve 28 without excess or deficiency.

Moreover, the control system of the hydraulic shovel is configured to include bleed lines E, F extending from the hydraulic pumps A, B to the oil tank 3 respectively, and bleed valves 31, 32 which are electronically controlled by the controller 10, and control the flow rates of the bleed lines E, F respectively, as well as to perform the bleed flow rate control corresponding to each hydraulic actuator, in accordance with the operation amount of each hydraulic actuator operation lever, therefore, the bleed discharge flow rate control can be performed separately from the supply flow rate control or the discharge flow rate control, and further improvement of operability and work efficiency can be achieved.

Next, a second embodiment of the present invention will be discussed with reference to FIG. 6. The second embodiment is directed to provide a swing priority circuit between the swing motor 7 and the stick cylinder 8, and parts other than the swing priority circuit are the same as those in the first embodiment, and like components as those in the first embodiment are provided with the same reference numerals used in connection with the first embodiment and therefore the description thereof will be omitted.

Figure 6:
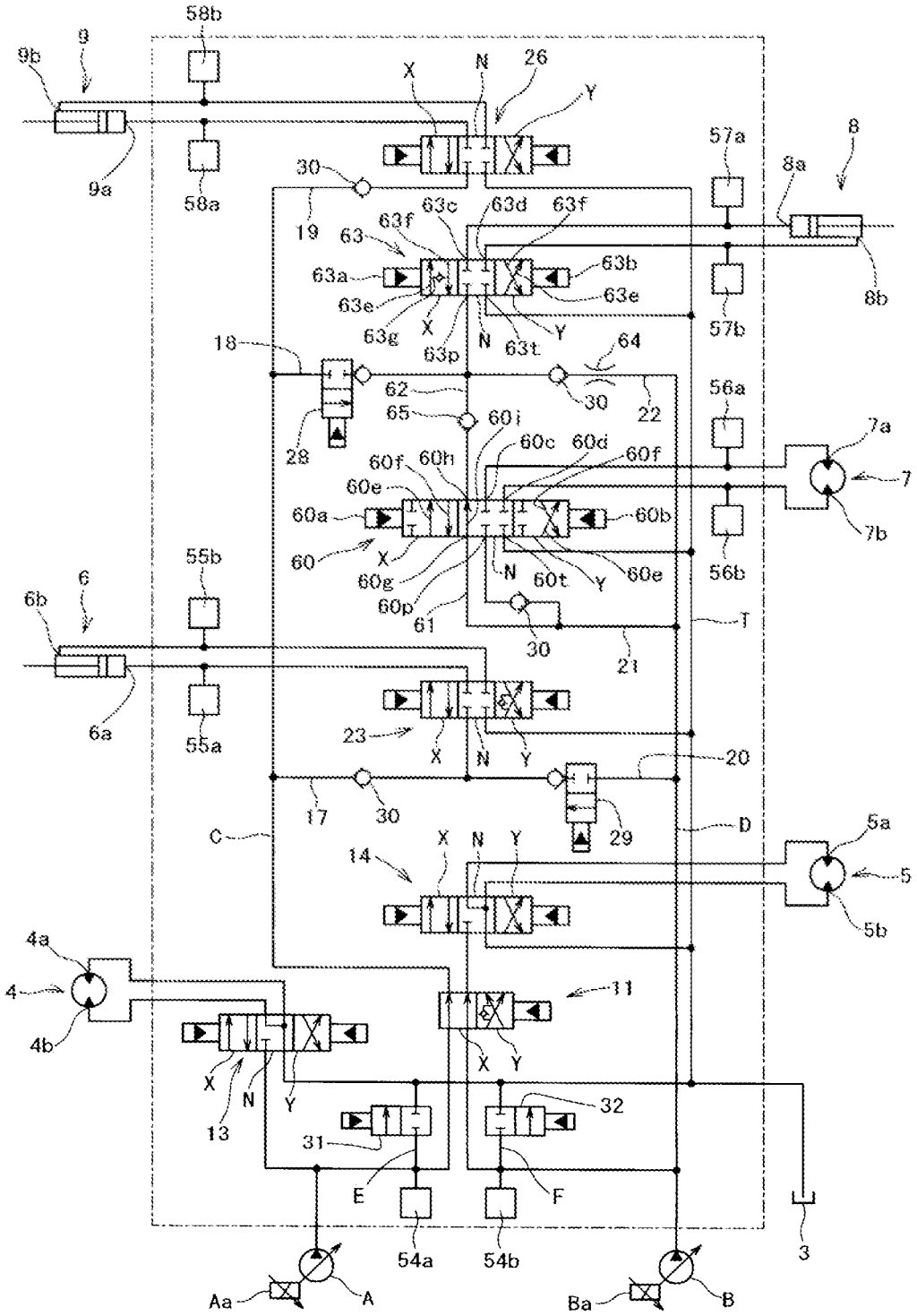
FIG. 6 is a hydraulic circuit diagram illustrating a second embodiment.
Figure 7:
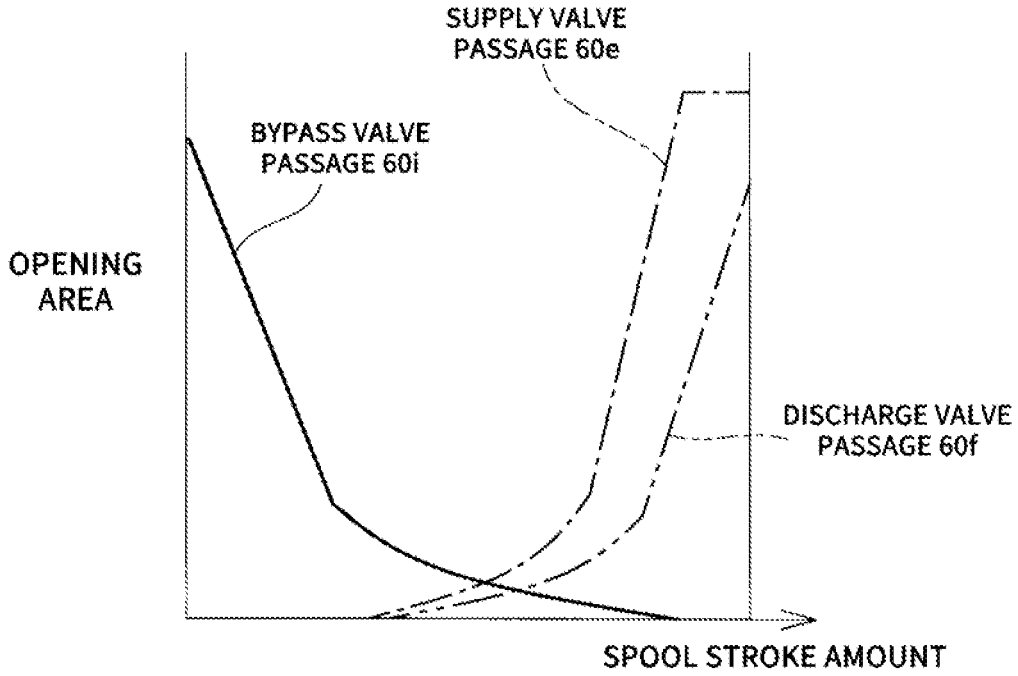
FIG. 7 is a diagram illustrating opening characteristics of a swing directional switching valve in the second embodiment.

In FIG. 6, reference numeral 60 denotes a swing directional switching valve of the second embodiment, and the swing directional switching valve 60 is a spool valve that performs supply and discharge flow rate control to and from the swing motor 7, and switches between the supply and discharge directions, similarly to the swing directional switching valve 24 of the first embodiment. The swing directional switching valve 60 includes a left swing-side, a right swing-side pilot ports 60*a*, 60*b* fluidly connected to swinging left swing-side, right swing-side solenoid proportional valve (not illustrated) which outputs a pilot pressure in response to a control signal output from the controller 10; a pump port 60*p* fluidly connected to the swing supply oil passage 21 supplied with pressurized oil from the hydraulic pump B; a tank port 60*t* fluidly connected to the tank line T; one actuator port 60*c* fluidly connected to the left swing-side port 7*a* of the swing motor 7; an another actuator port 60*d* fluidly connected to the right swing-side port 7*b* of the swing motor 7; a supply valve passage 60*e* extending from the pump port 60*p* to the actuator ports 60*c*, 60*d*; and a discharge valve passage 60*f* extending from the actuator ports 60*c*, 60*d* to the tank port 60*t*. Moreover, the swing directional switching valve 60 of the second embodiment includes a bypass inlet port 60*g* fluidly connected to a bypass inlet oil passage 61 branched and formed from the swing supply oil passage 21; a bypass outlet port 60*h* fluidly connected to a bypass outlet oil passage 62 described below; and a bypass valve passage 60*i* extending from the bypass inlet port 60*g* to the bypass outlet port 60*h*. Then, the swing directional switching valve 60 is positioned at a neutral position N at which the supply valve passage 60*e* and the discharge valve passage 60*f* are closed, in a state where a pilot pressure is not input to both the left swing-side, right swing-side pilot ports 60*a*, 60*b*, similarly to the swing directional switching valve 24 of the first embodiment, but is configured to be switched to a left swing-side actuation position X, a right swing-side actuation position Y, by a pilot pressure being input to the left swing-side, a right swing-side pilot ports 60*a*, 60*b*, to open the supply valve passage 60*e* and the discharge valve passage 60*f*; as well as the swing directional switching valve 60 is configured such that the opening areas of the supply valve passage 60*e* and the discharge valve passage 60*f* increase or decrease depending on an increase or decrease of a stroke amount of the spool. Moreover, however, the swing directional switching valve 60 of the second embodiment is configured to fully open a bypass valve passage 60*i* at the neutral position N, to be set so that the more the spool stroke amount increases, the more the opening area of the bypass valve passage 60*i* decreases, at the left swing-side actuation position X, the right swing-side actuation position Y to close the bypass valve passage 60*i* when the spool stroke amount is a maximum. In this case, as illustrated in FIG. 7, the bypass valve passage 60*i* is set to be in an almost closed, at the point in time when the supply valve passage 60*e* and the discharge valve passage 60*f* start to open. Consequently, the swing directional switching valve 60 is adapted such that, in a state where the swing operation lever is not operated, i.e., in a state where the swing directional switching valve 60 is positioned at the neutral position N and pressurized oil is not supplied to the swing motor 7, the discharged oil of the hydraulic pump B is supplied to the bypass outlet oil passage 62 via the bypass inlet oil passage 61, the bypass valve passage 60*i* of the swing directional switching valve 60 at the neutral position N, but when the swing operation lever is operated so that the pressurized oil of the hydraulic pump B is supplied to the swing motor 7, the pressurized oil is not supplied to the bypass outlet oil passage 62 by the bypass valve passage 60*i* being closed. In the following description, the bypass inlet oil passage 61, the bypass valve passage 60*i* of the swing directional switching valve 60, and the bypass outlet oil passage 62 may be collectively referred to as a swing priority tandem oil passage.

On the other hand, 63 denotes a stick directional switching valve of the second embodiment, and the stick directional switching valve 63, which is a spool valve that performs the supply and discharge flow rate control to and from the stick cylinder 8 and switches between the supply and discharge directions, includes extension-side, contraction side pilot port 63*a*, 63*b* fluidly connected to stick extension-side, contraction side solenoid proportional valve (not illustrated) that outputs a pilot pressure in response to a control signal output from the controller 10; a pump port 63*p* fluidly connected to the swing main-side supply oil passage 22 supplied with the pressurized oil from the hydraulic pump B and the swing sub-side supply oil passage 18 supplied with the pressurized oil from the hydraulic pump A; a tank port 63*t* fluidly connected to the tank line T; one actuator port 63*c* fluidly connected to the head-side port 8*a* of the stick cylinder 8; an another actuator port 63*d* fluidly connected to the rod-side port 8*b* of the stick cylinder 8; a supply valve passage 63*e* extending from the pump port 63*p* to the actuator ports 63*c*, 63*d*; a discharge valve passage 63*f* extending from the actuator ports 63*c*, 63*d* to the tank port 63*t*; and a regeneration valve passage 63*g* for supplying a part of the oil discharged from the another actuator port 63*d* as a regeneration oil to the one actuator port 63*c*. Then, the supply valve passage 63*e* is configured to perform the supply flow rate control at the first region S1 of the former half of the spool stroke, but does not perform the supply flow rate control at the second region S2 of the latter half of the spool stroke, similarly to the first embodiment, but the above-described bypass outlet oil passage 62 is further fluidly connected to the pump port 63*p* of the stick directional switching valve 63 of the second embodiment. Thus, the stick main-side supply oil passage 22 and the stick sub-side supply oil passage 18 and the bypass outlet oil passage 62 will be fluidly connected to the pump port 63*p* of the stick directional switching valve 63, but a throttle valve 64 that throttles the supply flow rate from the hydraulic pump B and a check valve 30 similar to that of the first embodiment are placed in the stick main-side supply oil passage 22, and the stick flow rate control valve 28 similar to that of the first embodiment is disposed in the stick sub-side supply oil passage 18, and further in a bypass outlet oil passage 62, there is disposed a check valve 65 that allows for the flow of oil from the bypass outlet port 60*h* of the swing directional switching valve 60 to the pump port 63*p* of the stick directional switching valve 63 but blocks off the backflow.

In the hydraulic control system of the second embodiment, the stick cylinder 8, the stick directional switching valve 63, and the stick main-side supply oil passage 22 correspond to the first hydraulic actuator, the first hydraulic actuator directional switching valve, and the first hydraulic actuator main-side supply oil passage of the present invention respectively. The swing motor 7, the swing operation lever, the swing directional switching valve 60, and the swing supply oil passage 21 correspond to the second hydraulic actuator, the second hydraulic actuator operation lever, the second hydraulic actuator directional switching valve, and the second hydraulic actuator supply oil passage of the present invention respectively, and the hydraulic pump B corresponds to the first hydraulic pump of the present invention.

In the second embodiment configured in this manner, when only the swing operation lever is operated independently, the discharged oil of the hydraulic pump B will be supplied only to the swing motor 7, and sufficient supply of the pressurized oil to the swing motor 7 can be performed. Further, when only the stick operation lever is operated independently, the discharged oil of the hydraulic pump B will be supplied only to the stick cylinder 8. In this case, however, the discharged oil of the hydraulic pump B will be supplied via not only the supply oil passage 22 but also the swing priority tandem oil passage (the bypass inlet oil passage 61, the bypass valve passage 60*i* of the swing directional switching valve 60, the bypass outlet oil passage 62), and thus, even if the throttle valve 64 is disposed in the stick main-side supply oil passage 22, sufficient supply of the pressurized oil can be performed without delay. Moreover, the discharged oil of the hydraulic pump A whose flow rate is controlled by the stick flow rate control valve 28 is also supplied to the stick cylinder 8, but the supply flow rate control of the stick flow rate control valve 28 and the stick directional switching valve 63 is similar to the first embodiment described above and therefore the description thereof will be omitted.

On the other hand, when the swing operation lever and the stick operation lever are combinedly operated, the discharged oil of the hydraulic pump B will be shared between the swing motor 7 and the stick cylinder 8. In this case, however, the swing direction switching valve 60 is positioned at the left swing-side or right swing-side actuation position X, Y to close (or almost close) the bypass valve passage 60*i*, and therefore the pressurized oil supply from the hydraulic pump B to the stick directional switching valve 63 will be performed by passing through the throttle valve 64 provided in the stick supply oil passage 22, and thus the discharged oil of the hydraulic pump B will be preferentially supplied to the swing directional switching valve 60. Consequently, it becomes possible to avoid the pressurized oil supply to the swing motor 7 from becoming insufficient and the swing speed from falling, when the swing operation lever and the stick operation lever are combinedly operated. On the other hand, it is possible to prevent the actuation speed of the stick cylinder 8 from falling, by controlling the stick flow control valve 28 to increase the supply flow rate from the hydraulic pump A to the stick cylinder 8, depending on necessity.

Thus, in the hydraulic control system of the second embodiment configured in this manner, the configuration is such that the swing priority tandem oil passage (the bypass inlet oil passage 61, the bypass valve passage 60*i* of the swing directional switching valve 60, and the bypass outlet oil passage 62) is provided between the stick directional switching valve 63 and the swing directional switching valve 60, and when the stick operation lever and the swing operation lever are combinedly operated, the pressurized oil supply to the swing motor 7 is prioritized. However, the bypass valve passage 60*i* formed in the swing directional switching valve 60 in order to form the above-described swing priority tandem oil passage is a dedicated valve passage to be used only for the purpose of the swing priority control without being used for other controls such as the bleed flow control. Therefore, the bypass valve passage 60*i* has a high degree of freedom in design and can perform highly precise swing priority control.

Figure 8:
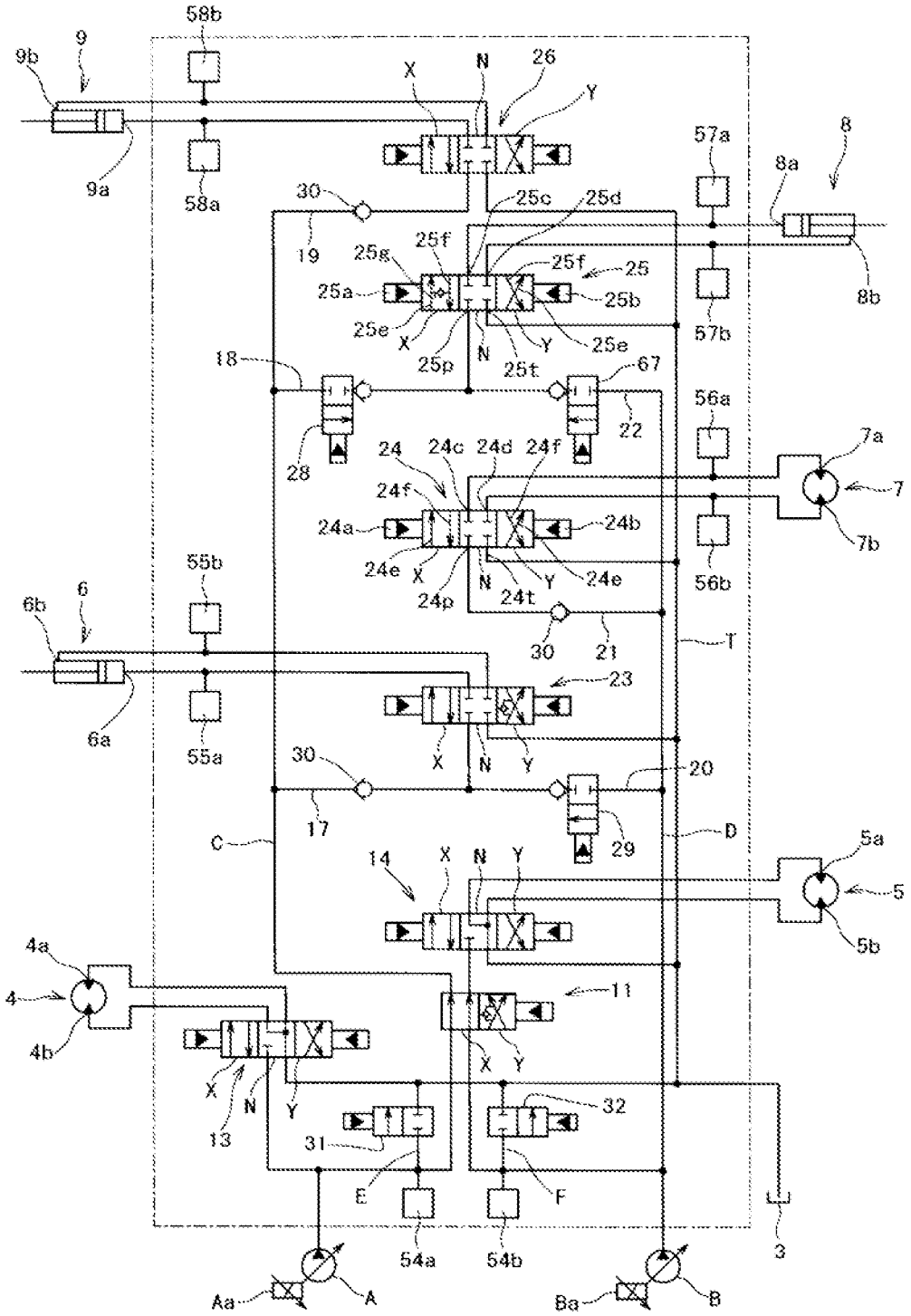
FIG. 8 is a hydraulic circuit diagram illustrating a third embodiment.

Next, a third embodiment of the present invention will be discussed with reference to FIG. 8. In the third embodiment, a swing priority flow rate control valve 67 is disposed in the stick main-side supply oil passage 22, and components other than the swing priority flow rate control valve 67 are the same as those in the first embodiment, and like components as those in the first embodiment are provided with the same reference numerals used in connection with the first embodiment and therefore the description thereof will be omitted.

The above-described swing priority flow rate control valve 67, which is a poppet valve for controlling the supply flow rate from the hydraulic pump B to the stick directional switching valve 25, with a similar structure to that of the stick flow rate control valve 28 disposed in in the stick sub-side supply oil passage 18, is pilot-operated by a swing priority solenoid proportional valve (not illustrated) that is actuated in response to a control signal output from the controller 10. Then, the swing priority flow rate control valve 67 is controlled so as to fully open the stick main-side supply oil passage 22 when only the stick operation lever is operated, in response to the control signal output from the controller 10 to the swing priority solenoid proportional valve; on the other hand, the swing priority flow rate control valve 67 is controlled so as to reduce the supply flow rate from the hydraulic pump B to the stick directional switching valve 25, when the swing operation lever and the stick operation lever are simultaneously operated. Consequently, when the swing operation lever and the stick operation lever are combinedly operated, the discharged oil of the hydraulic pump B serving as hydraulic pressure supply sources of the swing motor 7 and the stick cylinder 8 will be preferentially supplied to the swing motor 7, thereby enabling to avoid a swing speed from falling during the combined operation. Further, the actuation speed of the stick cylinder 8 can be prevented from falling, by controlling the stick flow rate control valve 28 so as to increase the supply flow rate from the hydraulic pump A to the stick cylinder 8, depending on necessity.

In the hydraulic control system of the third embodiment configured in this manner, it is adapted to perform the swing priority control when the stick operation lever and the swing operation lever are combined, by the swing priority flow control valve 67 disposed in the stick main-side supply oil passage 22, and since it becomes necessary to add a swing priority flow rate control valve 67 and a swing priority solenoid control valve for pilot-operating the swing priority flow rate control valve 67 in response to a control signal from the controller 10, it becomes disadvantageous in terms of cost, but since it is possible to directly reduce the supply flow rate from the hydraulic pump B to the stick directional switching valve 25 when combinedly operated, by the swing priority flow rate control valve 67, it becomes simple in terms of control.

Moreover, a fourth embodiment of the present invention will be discussed with reference to FIG. 9. In the hydraulic control system according to the fourth embodiment, the oil supply and discharge control to and from the swing motor 7, the bucket cylinder 9 is different from that in the first embodiment, and also the swing priority flow rate control valve 67 similar to that of the third embodiment is disposed in the stick main-side supply oil passage 22, but other parts are the same as those of the first embodiment, and like components as those in the first embodiment are provided with the same reference numerals used in connection with the first embodiment and therefore the description thereof will be omitted.

Figure 9:
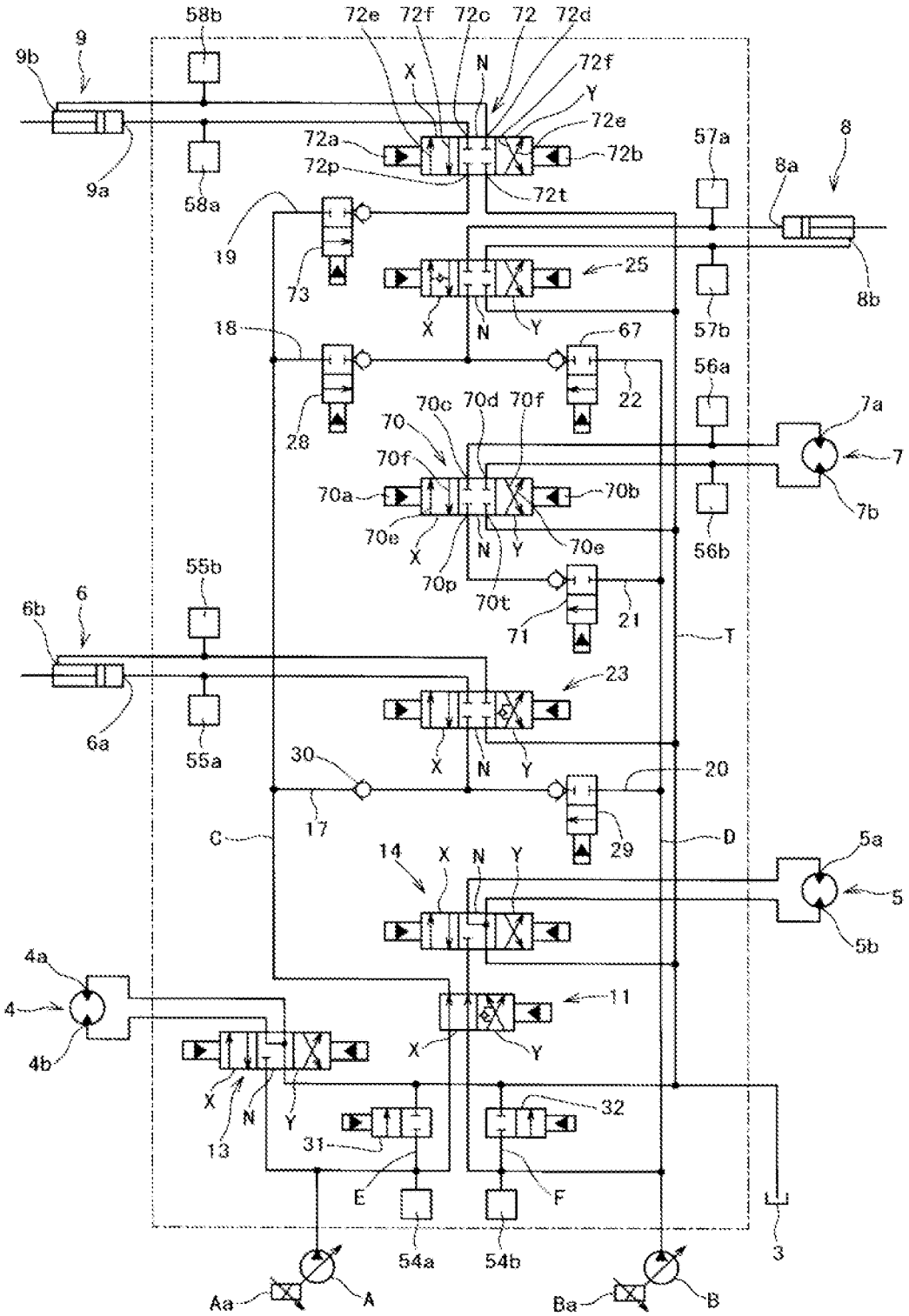
FIG. 9 is a hydraulic circuit diagram illustrating a fourth embodiment.

In FIG. 9, 70 denotes a swing directional switching valve, and the swing directional switching valve 70 includes swinging left swing-side, right swing-side pilot ports 70*a*, 70*b* fluidly connected to swinging left swing-side, right swing-side solenoid proportional valve (not illustrated) that outputs a pilot pressure in response to a control signal output from the controller 10; a pump port 70*p* fluidly connected to the swing supply oil passage 21; a tank port 70*t* fluidly connected to the tank line T; one actuator port 70*c* fluidly connected to the left swing-side port 7*a* of the swing motor 7; and an another actuator port 70*d* fluidly connected to the right swing-side port 7*b* of the swing motor 7. Then, the swing directional switching valve 70 is configured to be switched from a neutral position N to a left swing-side actuation position X by a pilot pressure being input to the left swing-side pilot port 70*a*, to open a supply valve passage 70*e* extending from the pump port 70*p* to the one actuator port 70*c* and a discharge valve passage 70*f* extending from the another actuator port 70*d* to the tank port 70*t*; and to be switched to a right swing-side actuation position Y by a pilot pressure being input to the right swing-side pilot port 70*b*, to open the supply valve passage 70*e* extending from the pump port 70*p* to the another actuator port 70*d*, and the discharge valve passage 70*f* extending from the one actuator port 70*c* to the tank port 70*t*. However, the supply valve passage 70*e* positioned at a left swing-side actuation position X or a right swing-side actuation position Y does not perform the supply flow rate control, an opening area thereof is set wide so that the flow rate supplied from the swing flow rate control valve 71 described below can be supplied to the swing motor 7 as it is. On the other hand, the opening area of the discharge valve passage 70*f* is controlled to increase or decrease depending on an increase or decrease of a spool stroke amount, and thereby the discharge flow rate control is performed corresponding to the increase or decrease of a pilot pressure output from the swinging left swing-side, right swing-side solenoid proportional valve in response to a control signal from the controller 10.

Reference numeral 72 denotes a bucket directional switching valve, and the bucket directional switching valve 72 has a structure similar to that of the swing directional switching valve 70 described above, and therefore it will be discussed simply. The bucket directional switching valve 72 includes extension-side, contraction-side pilot ports 72*a*, 72*b*; a pump port 72*p*; a tank port 72*t*; one actuator port 72*c*; and an anther actuator port 72*d*. Then, when the bucket directional switching valve 72 is switched from a neutral position N to an extension-side actuation position X, a contraction-side actuation position Y by a pilot pressure output from a bucket extension-side, contraction-side solenoid proportional valves (not illustrated), to open a supply valve passage 72*e* and a discharge valve passage 72*f*; in this case, however, an opening area of the supply valve passage 72*e* is set wide so that a flow rate supplied from a bucket flow rate control valve 73 as will be discussed below can be supplied to the bucket cylinder 9 as it is without performing supply flow rate control to the bucket cylinder 9. On the other hand, an opening area of the discharge valve passage 72*f* is controlled to increase or decrease depending on an increase or decrease of a spool stroke amount, and thereby the discharge flow rate control corresponding to the increase or decrease of a pilot pressure output from the bucket extension-side, contraction-side solenoid proportional valve in response to a control signal from the controller 10.

On the other hand, the swing flow rate control valve 71 is disposed in the swing supply oil passage 21 and is configured to control the supply flow rate from the hydraulic pump B to the swivel directional switching valve 70, and the bucket flow rate control valve 73 is disposed in the bucket supply oil passage 19 and is configured to control the supply flow rate from the hydraulic pump A to the bucket directional switching valve 72. The swing flow rate control valve 71, the bucket flow rate control valve 73 is a poppet valve that performs the flow rate control by being pilot-operated by a swing flow rate control solenoid proportional valve, a bucket flow rate control solenoid proportional valve (not illustrated) that is actuated in response to a control signal from the controller 10, and has the same structure as that of the stick flow rate control valve 28, the boom flow rate control valve 29 of the first embodiment.

In the hydraulic control system of the fourth embodiment configured in this manner, the supply flow rate control to the swing motor 7, the bucket cylinder 9 is performed by the swing flow rate control valve 71, the bucket flow rate control valve 73; on the other hand, the discharge flow rate control from the swing motor 7, the bucket cylinder 9 will be performed by the swing directional switching valve 70, the bucket directional switching valve 72. As a result, even in the swing motor 7, the bucket cylinder 9 supplied from one of the hydraulic pumps A, B, the supply flow rate control and the discharge flow rate control can be individually performed. In this hydraulic control system, since it becomes necessary to add the swing flow rate control valve 71; the bucket flow rate control valve 73, and the swing flow rate control solenoid proportional valve, the bucket flow rate control solenoid proportional valve that pilot-operates these flow rate control valves in response to control signals from the controller 10, a cost is high for that much, but by a small modification of adding the above valves to the hydraulic circuit of the first embodiment, it becomes possible to individually perform control of the supply flow rate and the discharge flow rate also with respect to the hydraulic actuators supplied from either one of the hydraulic pumps A, B, thereby achieving further improvement of operability and work efficiency.

INDUSTRIAL APPLICABILITY

The present invention can be utilized for a hydraulic control system for a working machine equipped with hydraulic actuators supplied with pressurized oil from both first, second hydraulic pumps.

The invention claimed is:

1. A hydraulic control system equipped with first, second hydraulic pumps; a first hydraulic actuator whose hydraulic supply source is both the first, second hydraulic pumps; and other hydraulic actuators whose hydraulic supply sources are at least one of the first, second hydraulic pumps, the hydraulic control system further comprising:

a first hydraulic actuator directional switching valve that has a supply valve passage and a discharge valve passage to and from the first hydraulic actuator and switches between supply and discharge directions;

a main-side supply oil passage, a sub-side supply oil passage that connects the first, second hydraulic pumps to pump ports of the first hydraulic actuator directional switching valve, respectively;

a first hydraulic actuator flow rate control valve that is placed at the sub-side supply oil passage, and controls a supply flow rate from the second hydraulic pump to the first hydraulic actuator directional switching valve; and a control means for electronically controlling the first hydraulic actuator directional switching valve and the first hydraulic actuator flow rate control valve, wherein the first hydraulic actuator flow rate control valve is configured such that in a state where the first hydraulic actuator flow rate control valve is closing the sub-side supply oil passage, only a supply flow rate from the first hydraulic pump via the main-side supply oil passage is supplied to the first hydraulic actuator directional switching valve, and in a state where the first hydraulic actuator flow rate control valve is opening the sub-side supply oil passage, a control flow rate from the second hydraulic pump whose flow rate has been controlled by the first hydraulic actuator flow control valve and the supply flow rate from the first hydraulic pump are supplied to the first hydraulic actuator directional switching valve; and on the other hand, wherein the first hydraulic actuator directional switching valve is a spool valve having a spool that is moved in proportion to an operation amount of a first hydraulic actuator operation lever, and is configured, in a first region of the former half of the spool stroke, to perform a supply flow rate control in accordance with an opening area of the supply valve passage that is increased or decreased depending on a spool stroke amount, and at a second region of the latter half of the spool stroke, to supply the flow rate input to a pump port to the first hydraulic actuator as it is without performing the supply flow rate control, since the opening area of the supply valve passage is set wider than when the supply flow rate control is performed; on the other hand, to perform a discharge flow rate control in accordance with an opening area of the discharge valve passage that is increased or decreased depending on the spool stroke amount in both the first and second regions; as well as, wherein the control means is configured, in case where only the supply flow rate from the first hydraulic pump is sufficient for the supply flow rate to the first hydraulic actuator, to cause the sub-side supply oil passage to be closed by the first hydraulic actuator flow rate control valve, as well as to cause the spool of the first hydraulic actuator directional switching valve to be positioned at the first region, to perform the supply flow rate control from the first hydraulic pump to the first hydraulic actuator in accordance with an opening area of the supply valve passage of the first hydraulic actuator directional switching valve; on the other hand, in case where the supply flow rate to the first hydraulic actuator requires the flow rates from both the first and second hydraulic pumps, then to control the first hydraulic actuator flow rate control valve so that the supply flow rate from the second hydraulic pump to the first hydraulic actuator directional switching valve is increased in proportion to an operation amount of the first hydraulic actuator operation lever, and to cause the spool of the first hydraulic actuator directional switching valve to be positioned at the second region, to allow a total flow rate of the control flow rate from the second hydraulic pump controlled by the first hydraulic actuator flow rate control valve and the supply flow rate from the first hydraulic pump to be supplied to the first hydraulic actuator via the supply valve passage of the first hydraulic actuator directional switching valve.

2. The hydraulic control system according to claim 1, wherein a pump control means for controlling a discharge flow rate of the first, second hydraulic pumps in accordance with an amount of a hydraulic actuator operation lever is provided, as well as the pump control means, in case where only the first hydraulic actuator operation lever is operated without other hydraulic actuators operation levers being operated, increases the discharge flow rate of the first hydraulic pump in proportion to an operation amount of the operation lever, when an operation amount of the first hydraulic actuator operation lever is less than a set value; on the other hand, further increases the discharge flow rate of the first hydraulic pump in proportion to the operation amount of the operation lever, when the discharge flow rate of the second hydraulic pump is maintained at a minimum flow rate, and the operation amount of the first hydraulic actuator operation lever is greater than or equal to a set value; on the other hand, increases the discharge flow rate of the second hydraulic pump in proportion to the operation amount of the operation lever.

3. The hydraulic control system according to claim 1, further comprising bleed lines extending from the first, second hydraulic pumps to an oil tank respectively, and bleed valves that are electronically controlled by the control means, and control flow rates of the bleed lines respectively, wherein the control means performs a bleed flow rate control corresponding to each hydraulic actuator, in accordance with an operation amount of each hydraulic actuator operation lever.

4. The hydraulic control system according to claim 3, wherein other hydraulic actuators include a second hydraulic actuator whose hydraulic supply source is only the first hydraulic pump, wherein the hydraulic control system further comprises:

a second hydraulic actuator directional switching valve that is electronically controlled by the control means, and performs a supply flow rate control with respect to the second hydraulic actuator in accordance with an operation of a second hydraulic actuator operation lever, as well as switches between the supply and discharge directions of oil;

a second hydraulic actuator supply oil passage that is provided in parallel with a first hydraulic actuator main-side supply oil passage and connects the first hydraulic pump to a pump port of the second hydraulic actuator directional switching valve;

a bypass inlet oil passage that is branched and formed from the second hydraulic actuator supply oil passage and connects the first hydraulic pump to a bypass inlet port formed on the second hydraulic actuator directional switching valve; and a bypass outlet oil passage extending from a bypass outlet port formed on the second hydraulic actuator directional switching valve to a pump port of the first hydraulic actuator directional switching valve; as well as, wherein the second hydraulic actuator directional switching valve has a bypass valve passage extending from the bypass inlet port to the bypass outlet port, an opening area of the bypass valve passage is set so as to reach a maximum when the second hydraulic actuator operation lever is not operated, to decrease with increasing operation amount of the operation lever, and to close the valve passage when the operation amount of the operation lever is maximum; on the other hand, a throttle valve for throttling the supply flow rate from the first hydraulic pump to the first hydraulic actuator directional switching valve is provided, in the first hydraulic actuator main-side supply oil passage.

5. The hydraulic control system according to claim 4 is a hydraulic control system for a hydraulic shovel comprising a plurality of hydraulic actuators including a stick cylinder, a swing motor, and wherein the first hydraulic actuator serves as the stick cylinder, and the second hydraulic actuator serves as the swing motor.

* * * * *